US011596572B2

(12) United States Patent
Vaille

(10) Patent No.: US 11,596,572 B2
(45) Date of Patent: Mar. 7, 2023

(54) MASSAGE CHAIR ASSEMBLIES WITH AIR CELL APPARATUSES AND METHODS FOR PROVIDING THE SAME

(71) Applicant: FFL BRANDS LLC, Boulder, CO (US)

(72) Inventor: John Scott Vaille, Thornton, CO (US)

(73) Assignee: FFL BRANDS LLC, Boulder, CO (US)

( * ) Notice: Subject to any disclaimer, the term of this patent is extended or adjusted under 35 U.S.C. 154(b) by 0 days.

(21) Appl. No.: 17/751,176

(22) Filed: May 23, 2022

(65) Prior Publication Data

US 2022/0378647 A1 Dec. 1, 2022

Related U.S. Application Data

(60) Provisional application No. 63/192,762, filed on May 25, 2021.

(51) Int. Cl.
*A61H 9/00* (2006.01)

(52) U.S. Cl.
CPC ... *A61H 9/0078* (2013.01); *A61H 2201/0149* (2013.01); *A61H 2201/0192* (2013.01); *A61H 2201/1623* (2013.01); *A61H 2203/0431* (2013.01); *A61H 2205/062* (2013.01)

(58) Field of Classification Search
CPC ..... A61H 9/0078; A61H 2205/062; A61H 2201/0192; A61H 2203/0431; A61H 9/00; A61H 15/00; A61H 2201/0149; A61H 2201/1623
See application file for complete search history.

(56) References Cited

U.S. PATENT DOCUMENTS

| | | | | |
|---|---|---|---|---|
| 5,762,618 | A | 6/1998 | Yamanaka et al. | |
| 6,315,744 | B1 | 11/2001 | Inaba | |
| 7,914,471 | B2 | 3/2011 | Chen | |
| 10,639,230 | B2 * | 5/2020 | Le | A61H 1/00 |
| 2005/0146176 | A1 | 7/2005 | Yoda et al. | |
| 2006/0069325 | A1 | 3/2006 | Inada et al. | |
| 2006/0142676 | A1 | 6/2006 | Fujii et al. | |
| 2007/0016119 | A1 * | 1/2007 | Inada | A61H 9/0078 601/151 |
| 2010/0198120 | A1 * | 8/2010 | Tago | A61H 1/0292 601/149 |
| 2012/0157899 | A1 * | 6/2012 | Terada | A61H 9/0078 601/149 |

(Continued)

*Primary Examiner* — Philip R Wiest
*Assistant Examiner* — Tyler A Raubenstraw
(74) *Attorney, Agent, or Firm* — Bryan Cave Leighton Paisner LLP

(57) ABSTRACT

This disclosure relates to improved massage chairs that include air cell apparatuses. A massage chair can include at least one air cell apparatus, which can be integrated into a shoulder portion, leg rest portion, arm portion, and/or other portion of the massage chair. An inflatable air bladder can be connected to each air cell apparatus. Each air cell apparatus can transition between a retracted position and an extended position. The air cell bladder can be configured to inflate when the air cell apparatus is in the extended position, thereby securing an individual to the massage chair. Various assemblies can be used to transition the air cell apparatus between the retracted and extended positions. Other embodiments are disclosed.

21 Claims, 18 Drawing Sheets

(56) References Cited

U.S. PATENT DOCUMENTS

| | | | | |
|---|---|---|---|---|
| 2012/0215143 | A1 | 8/2012 | Inada et al. | |
| 2012/0316478 | A1 | 12/2012 | Inada et al. | |
| 2017/0258668 | A1* | 9/2017 | Sone | A61H 15/0078 |
| 2019/0151187 | A1* | 5/2019 | Nagamitsu | A61H 9/0078 |
| 2019/0160253 | A1 | 5/2019 | Bae et al. | |
| 2019/0231634 | A1* | 8/2019 | Inada | A61H 23/04 |
| 2019/0328608 | A1* | 10/2019 | Le | A61H 23/006 |
| 2019/0374425 | A1 | 12/2019 | Park et al. | |
| 2020/0281806 | A1* | 9/2020 | Le | A61H 1/00 |
| 2020/0397651 | A1* | 12/2020 | Park | A61H 9/0078 |
| 2020/0405568 | A1* | 12/2020 | Furutani | A61H 23/00 |
| 2021/0085558 | A1* | 3/2021 | Shin | G10L 15/22 |
| 2021/0393473 | A1* | 12/2021 | Kim | A61B 5/6891 |

* cited by examiner

203

205

MASSAGE CHAIR ASSEMBLIES WITH AIR CELL APPARATUSES AND METHODS FOR PROVIDING THE SAME

CROSS-REFERENCE TO RELATED APPLICATIONS

This application claims benefit of, and priority to, U.S. Provisional Application No. 63/192,762 filed on May 25, 2021. The content of the above-identified application is herein incorporated by reference in its entirety.

TECHNICAL FIELD

The present disclosure is related to massage chairs and, more particularly, to massage chairs that are equipped with one or more air cell apparatuses for securing individuals in massage chairs.

BACKGROUND

Electronic massage chairs can include various massaging components that enable individuals to receive a mechanical or robotic massage. For example, an electronic massage chair typically includes a seat, and the massaging components incorporated into the massage chair can be activated or programmed to massage the individual's body while he or she is seated on the massage chair. However, obtaining a comfortable massage can be difficult in many cases. For example, certain programs operate the massaging components to simulate massages that knead (e.g., a deep tissue massage). During a traditional massage (e.g., one outside of a massage chair), an individual is lying face down on a table and the masseuse can massage the individual with varying degrees of pressure without the individual moving. However, in massage chairs, the individual is sitting in the chair positioned on the massage components and the force of the massage components often push the individual (or individual's body parts) forward in the chair and/or cause the individual to be jostled around during programs that simulate more intense massage techniques. This can be uncomfortable for the individual and does not result in an effective massage.

Accordingly, there is a need for improved massage chairs that can secure individuals or their body parts in proper positions during a massage, while also ensuring the comfort of those individuals.

BRIEF DESCRIPTION OF DRAWINGS

To facilitate further description of the embodiments, the following drawings are provided, in which like references are intended to refer to like or corresponding parts, and in which.

Figure 1:
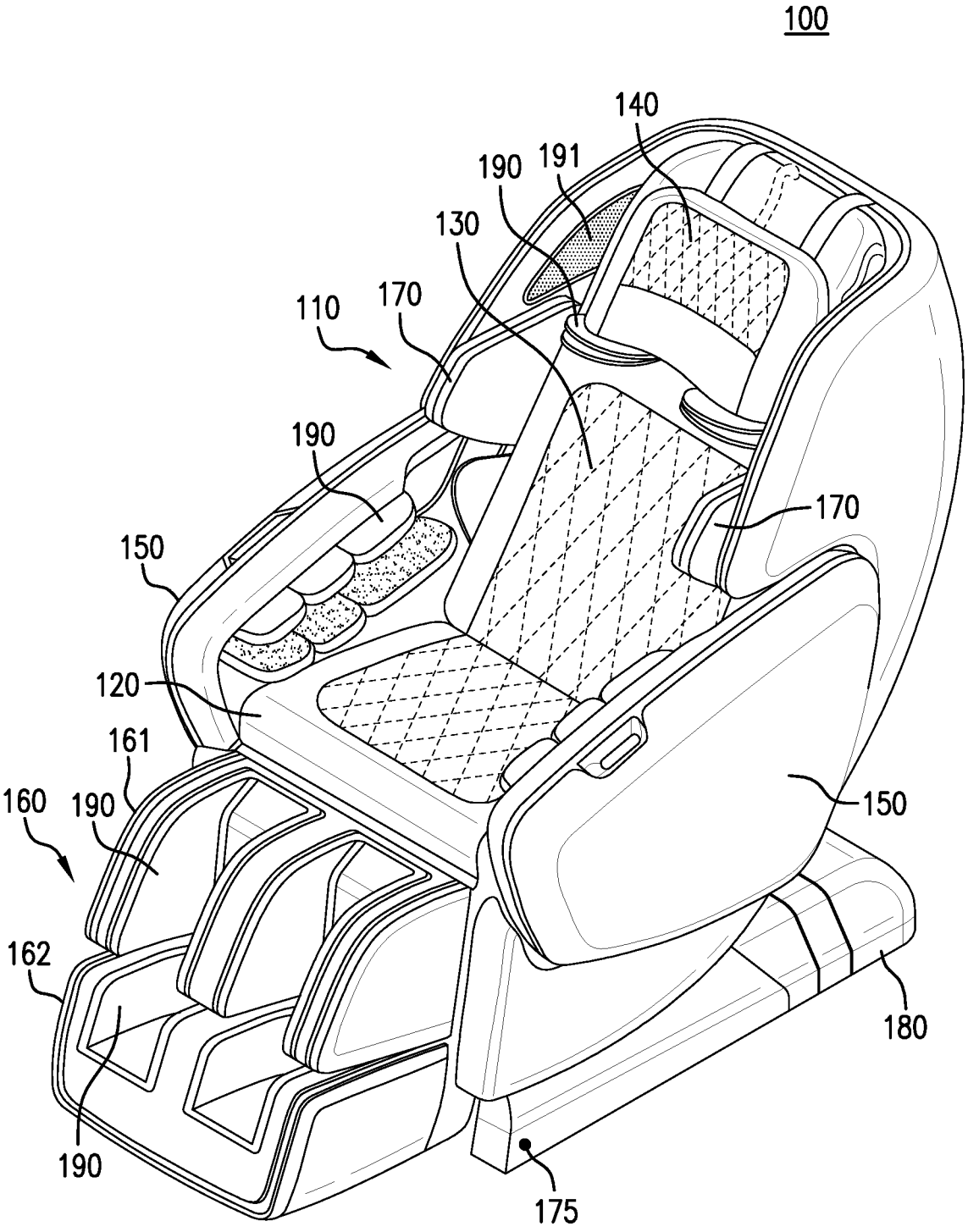
FIG. 1 is a front perspective view of an exemplary massage chair according to certain embodiments.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Coupling may be for any length of time, e.g., permanent or semi-permanent or only for an instant. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DETAILED DESCRIPTION OF EXEMPLARY EMBODIMENTS

The present disclosure is related to improved massage chairs, features, components, and associated methods. The improved massage chairs can include one or more air cell apparatuses, each of which can be configured to extend and inflate to secure an individual or the individual's body parts to a massage chair while one or more massage components or programs associated with the massage chairs are activated. Securing the individual to the massage chair with the one or more air cell apparatuses enables the individual to obtain a higher quality massage, and prevents (or at least mitigates) the individual from jostling around while massage programs are administered and/or the one or more massage components are activated. Additionally, the securing mechanism facilitated by the air cell apparatuses can include an air cell interface that engages the individual seated in the massage chair. This air cell interface can accommodate limited movements of the individual and promote comfortability of the individual.

In certain embodiments, the massage chairs can include two or more air cell apparatuses that secure certain body parts of an individual in response to the massage chair being operated. For example, in some cases, pairs of the air cell apparatuses described herein can be incorporated into a massage chair in a shoulder area, hand area, leg area, forearm area, foot area, and/or any other area on the massage chair where it be beneficial to secure an individual's body part or mitigate jostling of the individual.

In certain embodiments, an air cell apparatus can be configured to transition from a retracted position (when the securing mechanism is not desired) to an extended position (when the securing mechanism is desired). For example, in response to activating a massage program or component of a massage chair, one or more air cells of the air cell apparatuses can be configured to extend outward from surfaces of the massage chair to secure one or more of the individual's body parts (e.g., shoulders, hands, forearms, legs, feet, and/or other body part) in a desired position.

In certain embodiments, a single air cell is coupled to each air cell apparatus and the air cell is configured to transition to an extended position in response to a massage program or component of a massage chair being activated. Additionally, or alternatively, multiple air cells may be coupled to an air cell apparatus and each of the air cells can be configured to transition to an extended position in response to a massage program or component of a massage chair being activated.

Various mechanisms can be used to transition the air cell apparatuses between extended and retracted positions. As explained below, these mechanisms can include air bag expansion assemblies, actuator-driven assemblies, pneumatic or bellows-driven assemblies, bias spring assemblies, belt-and-pulley assemblies, and/or motor driven assemblies. It should be recognized that other types of assemblies (e.g., hydraulic assemblies, electromechanical assemblies, piezoelectric assemblies, etc.) may be utilized to transition the air cell apparatuses between extended and retracted positions.

The embodiments described in this disclosure can be combined in various ways. Any aspect or feature that is described for one embodiment can be incorporated to any other embodiment mentioned in this disclosure.

FIG. 1 discloses an exemplary massage chair that is equipped with air cell apparatuses in various locations according to certain embodiments. The massage chair illustrated in this drawing is intended to demonstrate, inter alia, exemplary locations where the air cell apparatuses may be located and how the air cell apparatuses can be used to secure various portions of an individual's body to the massage chair. In some cases, the air cell apparatuses can be located in any location that is near or adjacent to a massage component. Additionally, it should be recognized that the air cell apparatuses described herein can be incorporated into any type of massage chair (including massage chairs with different structures, housings, and/or massage components) and/or other types of chairs in which it be beneficial to secure an individual or an individual's body parts. Also, the air cell apparatuses can be incorporated into additional locations of the massage chair other than those explicitly mentioned herein.

Figure 8:
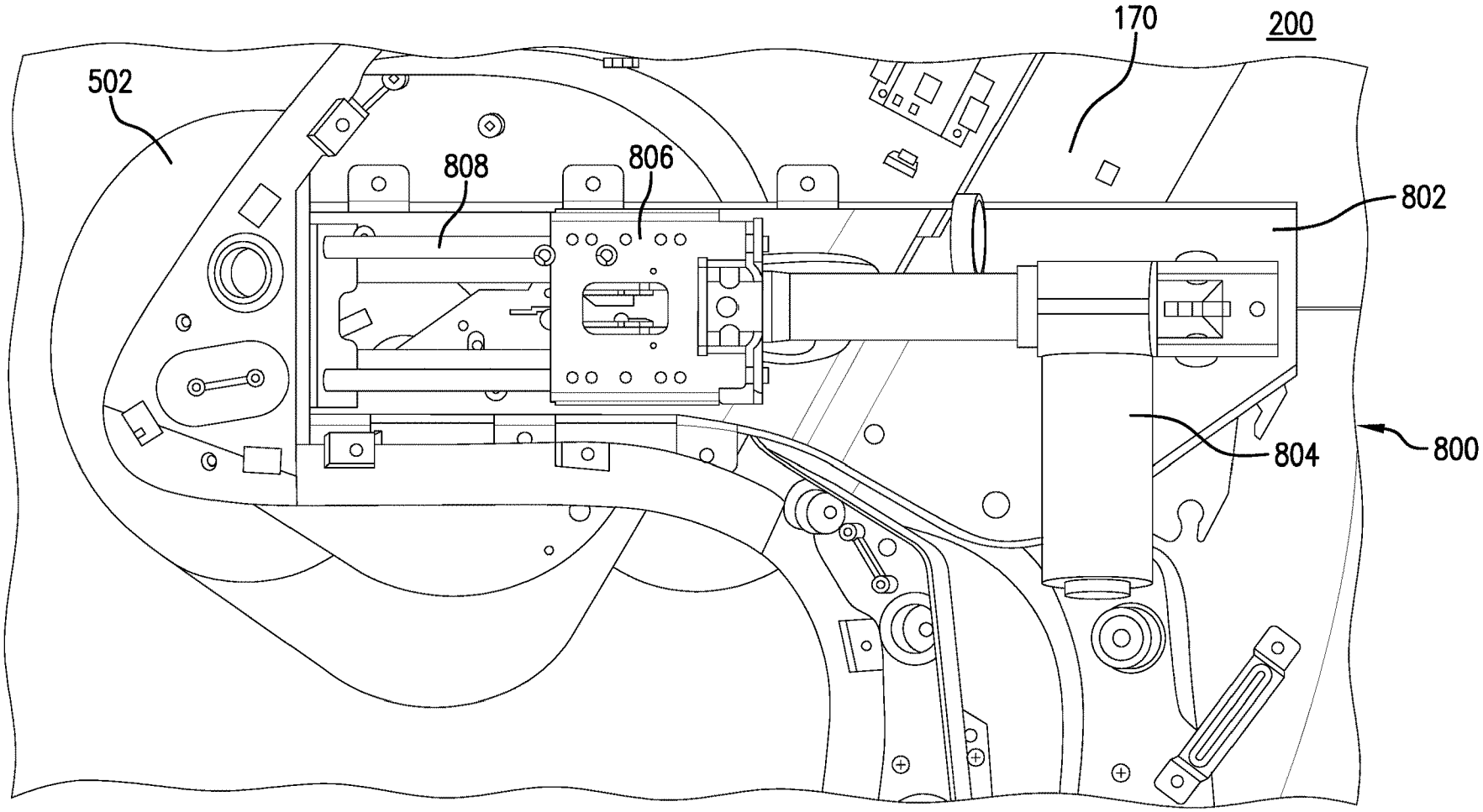
FIG. 8 is a cross-sectional view of an exemplary air cell apparatus according to certain embodiments.
Figure 9:
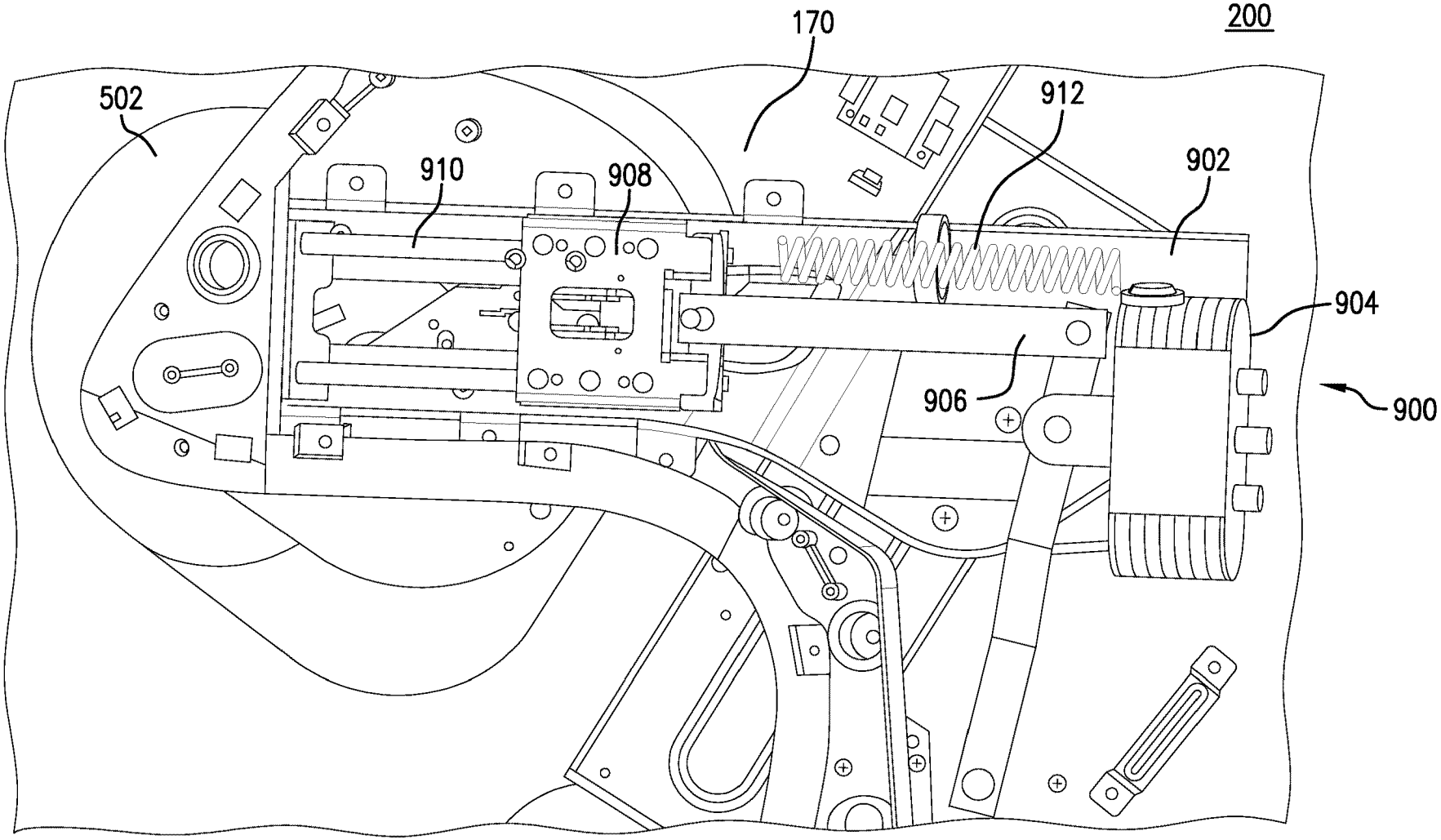
FIG. 9 is a cross-sectional view of an exemplary air cell apparatus according to certain embodiments.

FIGS. 2A-18 disclose exemplary embodiments of air cell apparatuses. Specifically, FIGS. 2A-7 disclose a first exemplary air cell apparatus corresponding to an air bag expansion assembly. FIG. 8 discloses a second exemplary air cell apparatus corresponding to a first actuator driven assembly. FIG. 9 discloses a third exemplary air cell apparatus corresponding to a first pneumatic assembly, FIG. 10 discloses a fourth exemplary air cell apparatus corresponding to a second actuator-driven assembly. FIGS. 11-18 disclose a fifth exemplary air cell apparatus corresponding to a second pneumatic assembly. The exemplary air cell apparatuses disclosed in these figures are not intended to be limiting in any manner whatsoever. Numerous modifications can be made to the air cell apparatuses as described in this disclosure. Any feature described for one embodiment of an air cell apparatus can be incorporated into any other embodiment disclosed herein. Additionally, other configurations of the air cell apparatuses also may be incorporated into the massage chairs.

Referring back to FIG. 1, an exemplary massage chair may include a base portion 110 (e.g., which includes a seat 120, backrest 130, and a head section 140), a pair of arms 150, a leg rest 160, and a support portion 180. The leg rest 160 may be comprised of two sections: a top section 161 that includes massage components 190 for massaging upper leg portions (e.g., thighs and calves) of an individual's legs; and lower section 162 that includes massage components 190 for massaging lower leg portions (e.g., ankles and feet) of an individual's legs. In certain embodiments, the leg rest 160 can be configured to rotate upward when the massage chair 100 transitions to one or more reclined positions.

The base portion 110 of the massage chair 100 may include a seat section 120 and backrest section 130 that is configured to receive an individual's body, and a head section 140 or pillow section that is located at the top of the backrest 130. In addition, the base portion 110 can include one or more shoulder portions 170 that protrude or extend outward from the backrest 130. In certain embodiments, the massage chair 100 may include a unitary cushion for the backrest section 130 and seat portion 120 of the massage chair 100 that can be flipped over the back of the massage chair 100 and/or detached from the massage chair 100. The massage chair 100 can also include one or more audio speakers 191 that are integrated into the base portion 110 of the massage chair near the head section 140 or pillow section of the backrest 130.

The configuration of the massage components 190 included in the massage chairs 100 can vary. A massage component 190 can represent any device that provides massage therapy and/or massaging functions. In certain embodiments, a massage component 190 can be a vibration device that provides massage therapy function using a vibration device or mechanism. Additionally, or alternatively, the massage chairs can include other types of massage components 190, such as mechanical massage units (e.g., which use motors, gears, kneading devices, and/or massage rollers), robotic massage units, and/or other types of massage units and devices. In some embodiments, the massage component 190 can have different operational settings or programs which control the intensity of the massage (e.g., low, medium, and high) and/or the massage pattern (e.g., constant/continuous, intermittent, wave setting, body part specific pattern, etc.).

In certain embodiments, air cell apparatuses can be positioned in, or incorporated into, various locations of the massage chair 100 to assist in securing the individual or the individual's body parts in the massage chair 100. In some embodiments, a pair of air cell apparatuses may be used to secure each of the individual's body parts. Additionally, or alternatively, a single air cell apparatus can be used to secure a body part of an individual.

In one example, a pair of shoulder portions 170 each can include an air cell apparatus to assist in securing an individual's shoulders or upper body in the massage chair 100. When a massage program or component (e.g., located in the backrest 130 or shoulder portions 170) is activated, the air cell apparatus included in each shoulder portion 170 also can be activated. Activation of the air cell apparatus can cause the air cell apparatus to transition from a retracted position 203 to an extended position 205 (e.g., to extend outward from the backrest 130) and to secure the individual's shoulders or upper body to the massage chair 100.

In another example, air cell apparatuses can be incorporated into, or integrated with, the leg rest 160 of the massage chair 100. When a massage program or component (e.g., located in the leg rest 160) is activated, air cell apparatuses in each leg portion can extend outward (e.g., away from the leg rest 160) to assist in securing an individual's legs and/or feet to the massage chair 100.

In a further example, air cell apparatuses can be incorporated into, or integrated with, the arms 150 of the massage chair 100. When a massage program or component (e.g., located in the arms 150) is activated, air cell apparatuses in each arm 150 can extend outward (e.g., inward toward the seat section 120) to assist in securing an individual's arms to the massage chair 100.

Air cell apparatuses can be incorporated into, or integrated with, other areas (e.g., lower torso areas, hip regions, etc.) of the massage chairs 100 to secure an individual's body to the massage chair 100 in a similar manner as describe above and throughout this disclosure.

In certain embodiments, when an air cell apparatus is transitioned to an extended position an air cell connected to the air cell apparatus inflates and covers a front portion of an individual's body part to assist with securing the individual in the massage chair. For example, for embodiments having a pair of air cell apparatuses incorporated into shoulder portions 170, an air cell may extend past the individual's shoulders and inflate to engage or cover the front portion of the individual's shoulders. Likewise, for embodiments having a pair of air cell apparatuses incorporated into a top section 161 of a leg rest 160, a pair of air cells may be situated on either side of an individual's leg and may extend beyond the exposed portion individual's leg when the air cell apparatus is in an extended position. When the air cell is inflated in the extended position, it may engage or cover the front or top of the user's leg to assist with securing the individual's leg in the leg rest 160. Air cell apparatuses equipped in other portions of the massage chair can operate in a similar manner to cover exposed body parts.

This securing mechanism that extends beyond and covers an individual's exposed body part can provide a better mechanism for securing body parts compared to other potential options. For example, consider an alternative securing mechanism in which the shoulder portions 170 simply includes inflatable air cells that are stationary (i.e., which do not extend outward). Activating the air cells would simply cause the air cells to push inward on an individual's shoulders, which may not adequately secure the individual's shoulders to the backrest 130 during administration of massage program. Thus, in many embodiments, the air cell apparatuses disclosed herein can be extendable to cover the front or exposed portions of the individual's shoulders or other body parts, thereby providing a better securing mechanism.

Figure 2A:
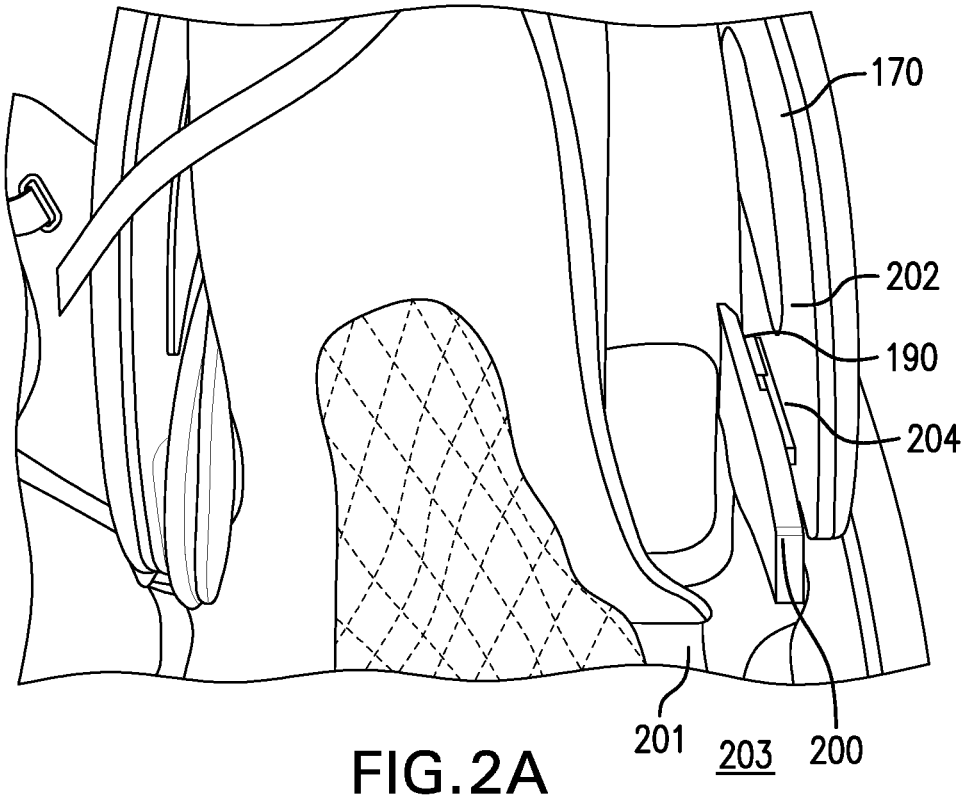
FIG. 2A illustrates an exemplary air cell apparatus in a retracted position according to certain embodiments.

FIG. 2A-7 disclose an exemplary embodiment of an air cell apparatus 200 that includes an air bag expansion assembly 201. FIGS. 2A-2B demonstrate how the air cell apparatus 200 can be coupled to or near the shoulder portion 170. As shown in FIG. 2A, the air cell apparatus 200 can be coupled to an inner surface 202 of the shoulder portion 170 via a mounting plate 204. In certain embodiments, the mounting plate 204 is positioned adjacent to one or more massage components 190 to assist in securing an individual in the massage chair 100, which can assist with mitigating jostling or undesired movements of an individual during administration of certain massage programs. Additionally, mounting the air cell apparatus 200 adjacent to the massage components 190 improves comfortability of the individual and the effectiveness of the massage.

In FIG. 2A, the air cell apparatus 200 is in the retracted position 203. The air cell apparatus 200 is in the retracted position prior to activation of the massaging mechanism and/or operation of the massage chair 100. For example, the air cell apparatus 200 can be in the retracted position while the massage chair 100 is powered off, or while the massage chair 100 is powered on (but prior to execution of a certain massage program). In certain embodiments, the air cell apparatus 200 may remain in the retracted position during certain massage programs. Alternatively, or additionally, the individual may program when the air cell apparatus 200 is to remain in the retracted position based on the individual's desired preferences.

Figure 2B:
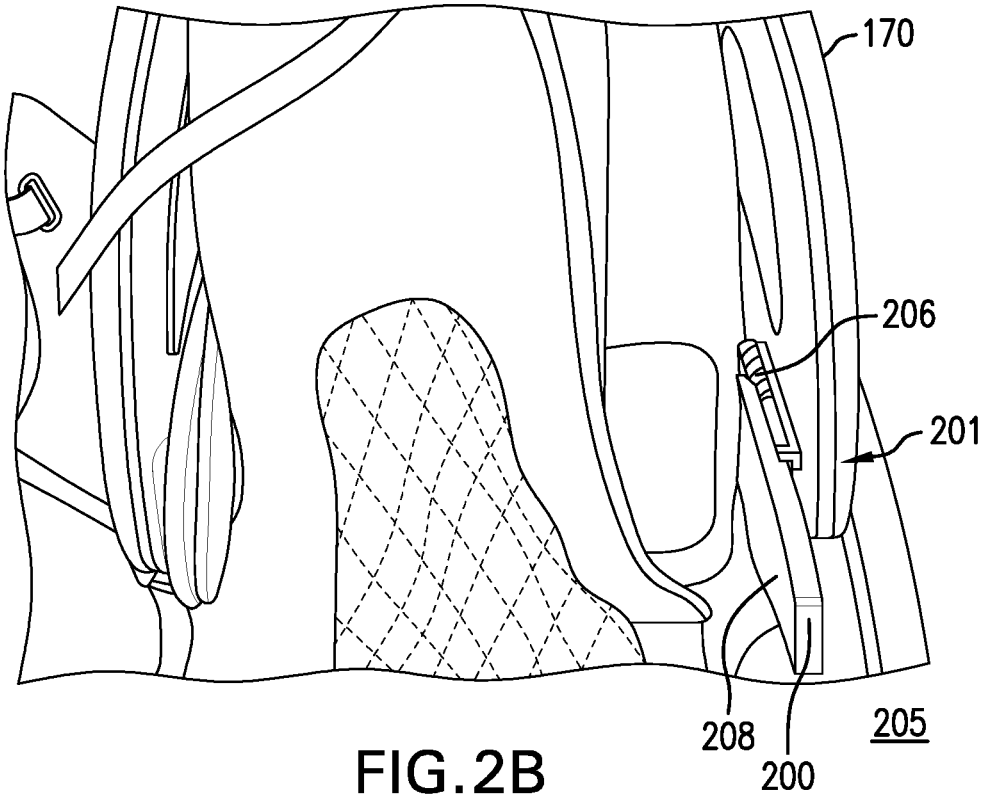
FIG. 2B illustrates the exemplary air cell apparatus in an extended position according to certain embodiments.

In FIG. 2B, the air cell apparatus 200 is in the extended position 205 to assist in securing an individual's upper body in the massage chair 100. In certain embodiments, the air cell apparatus 200 moves from the retracted position to the extended position via usage of an air pump (not shown). An air bag 206 is positioned within the mounting plate 204 and expands during operation of the massage chair 100 to extend the air cell apparatus 200 outwards and to inflate an air cell bladder 208, thereby securing an individual in the massage chair 100. In certain embodiments, when a massage program is completed, the air cell bladder 208 and the air bag 206 are deflated and the air cell apparatus 200 returns to the retracted position. In some cases, the air bag 206 may be formed of a shape memory polymer and/or a plastic having elastic properties that automatically or naturally cause the air cell apparatus 200 to return to the retracted position upon deflating of the air cell balder 208 and air bag 206.

Figure 3A:
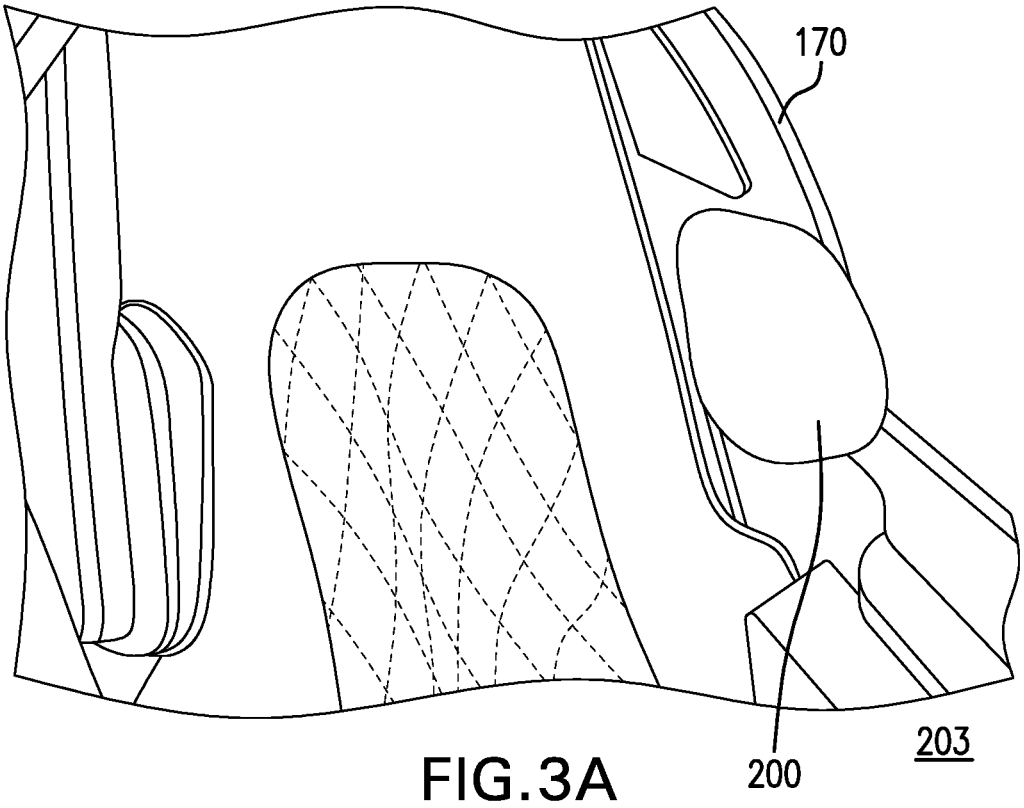
FIG. 3A is an alternative view of the air cell apparatus in a retracted position according to certain embodiments.
Figure 3B:
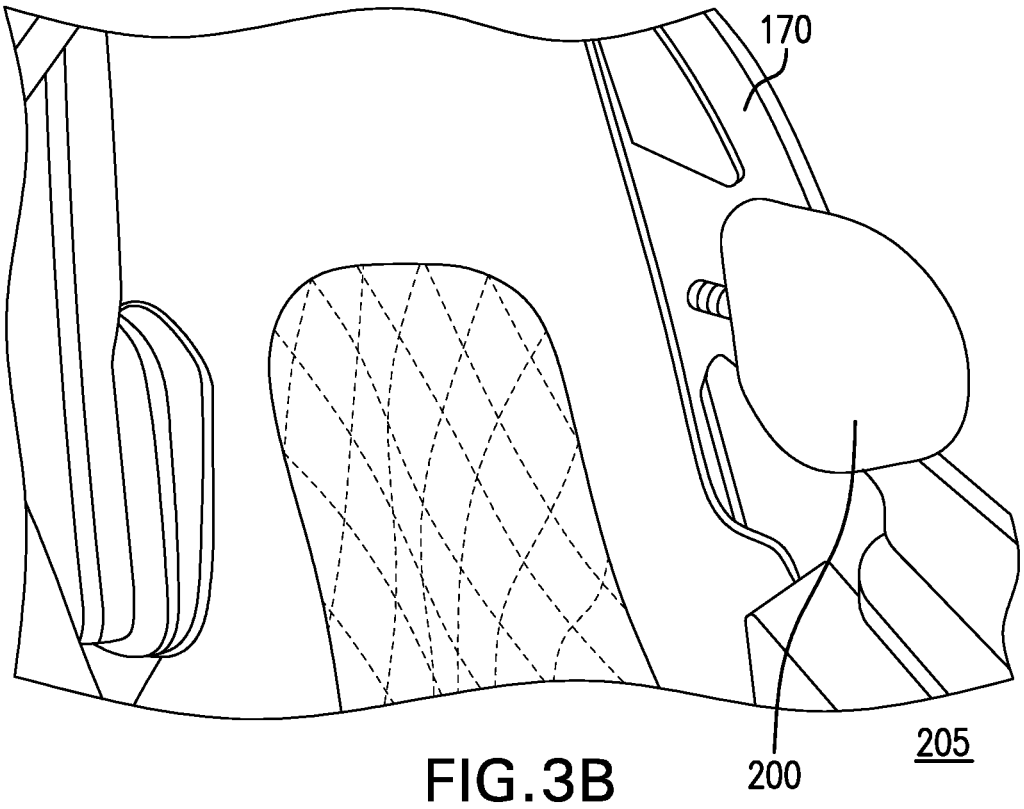
FIG. 3B is an alternate view of the exemplary air cell apparatus in an extended position according to certain embodiments.
Figure 4A:
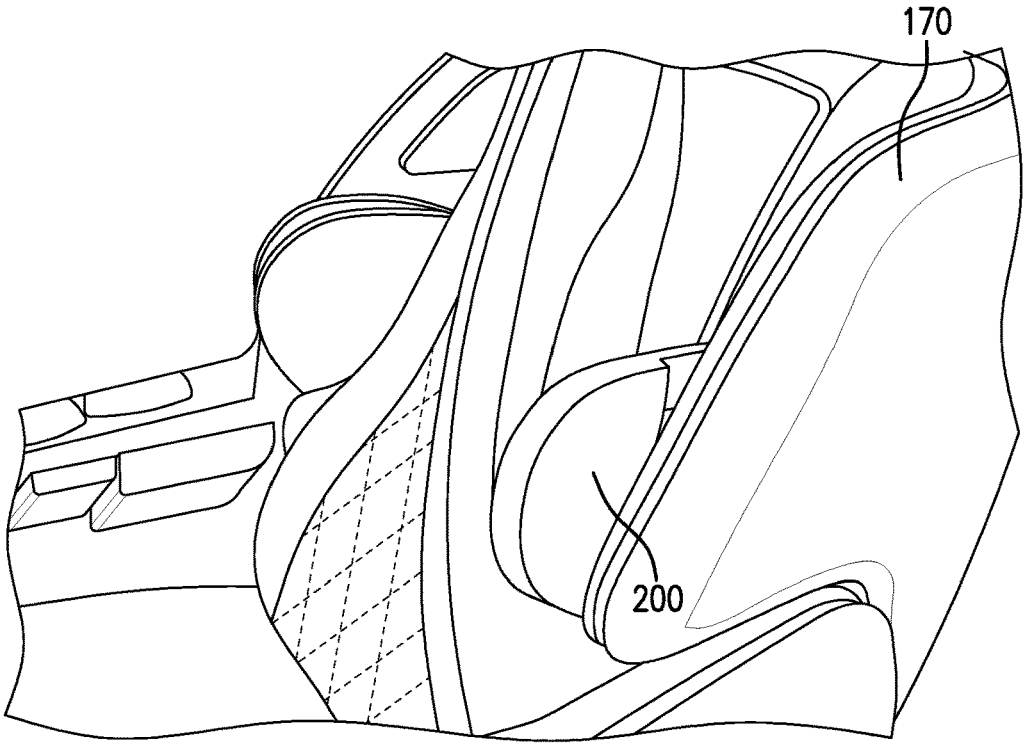
FIG. 4A is an alternative view of the air cell apparatus in a retracted position according to certain embodiments.
Figure 4B:
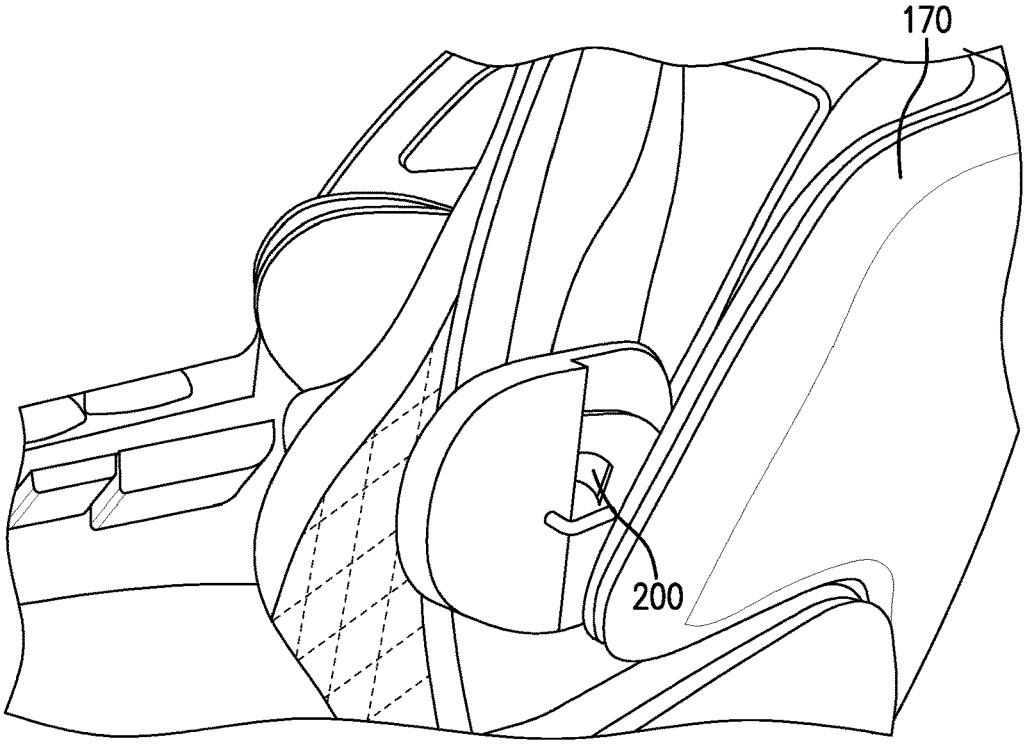
FIG. 4B is alternate view of the exemplary air cell apparatus in an extended position according to certain embodiments.

FIGS. 3A and 4A are alternate views of the air cell apparatus 200 in the retracted position 203. FIGS. 3B and 4B are alternate views of the air cell apparatus 200 in the extended position 205.

Figure 5A:
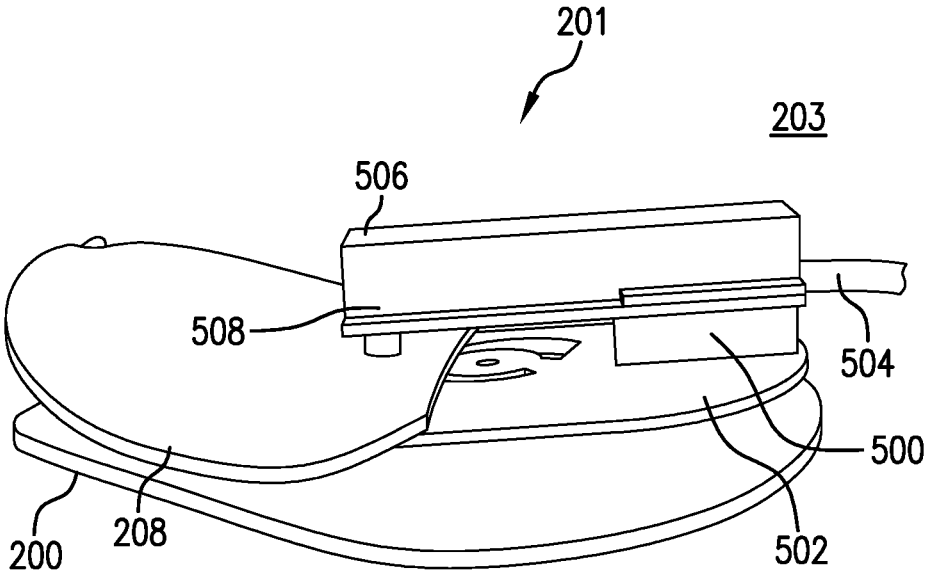
FIG. 5A is an isolated view of the exemplary air cell apparatus in a retracted position according to certain embodiments.
Figure 5B:
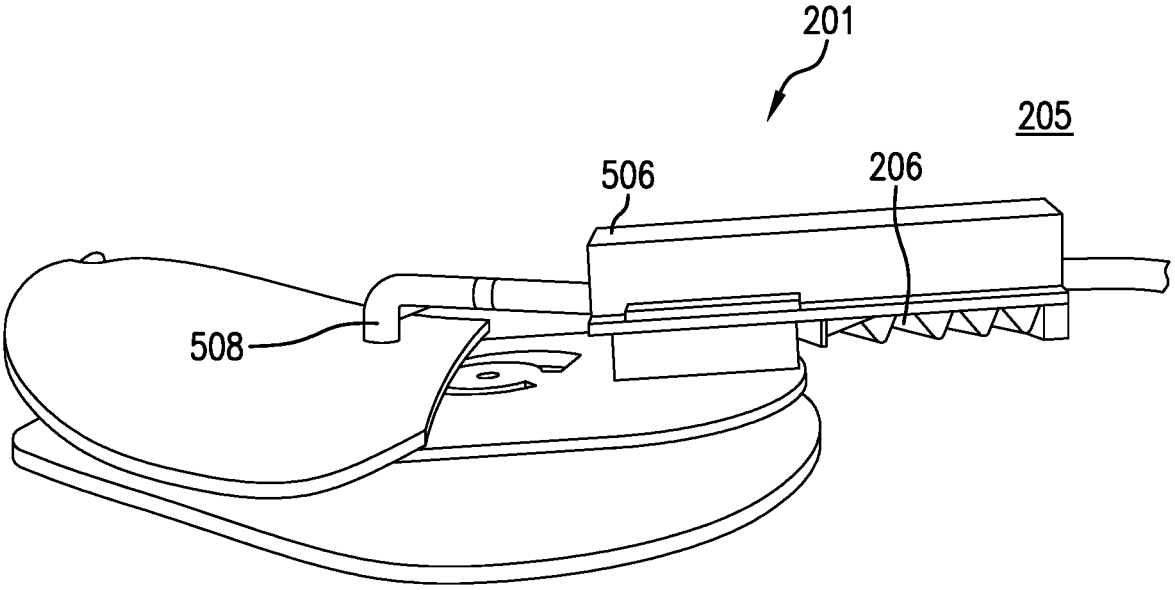
FIG. 5B is an isolated view of the exemplary air cell apparatus in an extended position according to certain embodiments.

FIGS. 5A and 5B are isolated views of the air cell apparatus 200. The air cell apparatus 200 includes a slider 500, an air cell bladder mount 502, and tubing 504. The slider 500 can be coupled to the mounting plate 204. In certain embodiments, the mounting plate 204 includes a male portion that is received by a corresponding female portion of the slider 500. The mounting plate 204 and the slider 500 can define a cavity to house the air bag 206. The slider 500 can be coupled to the air cell bladder mount 502, thereby coupling the air cell bladder mount 502 to the mounting plate 204. The air cell bladder 208 can be sealing engaged and/or contiguous within the air cell bladder mount 502 to maintain air within the air cell bladder 208.

In FIG. 5A, the air cell apparatus 200 is in the retracted position 203. During operation, the tubing 504 can provide a fluid (e.g., air, liquid, etc.) to the air bag 206 within the cavity defined by the mounting plate 204 and the slider 500. In response to receiving the fluid, the air bag 206 can expand and this expansion can cause the slider 500 to move along the mounting plate 204 and to extend the air cell bladder mount 502. In turn, this expansion can cause the air cell bladder 208 to move outward beyond a body part of the individual. The tubing 504 can continue to provide the fluid to the air bag 206 until the slider 500 reaches an end 506 of the mounting plate 204.

The tubing 504 also can provide fluid to the air cell bladder 208 while the slider 500 is extending toward the end 506 of the mounting plate 204 and/or after the slider 500 has extended to the end 506 of the mounting plate 204. In certain embodiments, the tubing 504 continues to provide fluid to the air cell bladder 208 until a threshold amount of fluid is within the air cell bladder 208 (e.g., until the air cell bladder 208 is fully inflated and/or until the air cell bladder 208 is inflated sufficiently to secure an individual in the massage chair). In certain embodiments, the threshold can be determined by a certain amount of pressure that is measured at an outlet 508 of the tubing 504. Alternatively, or additionally, the threshold can be a desired amount of fluid provided to the air cell bladder 208 that is determined based on the preferences of the individual. In the embodiment of FIG. 5B, the air cell bladder mount 502 and, thus, the air cell bladder 208 are in the extended position 205 to secure an individual in the massage chair 100.

Figure 6A:
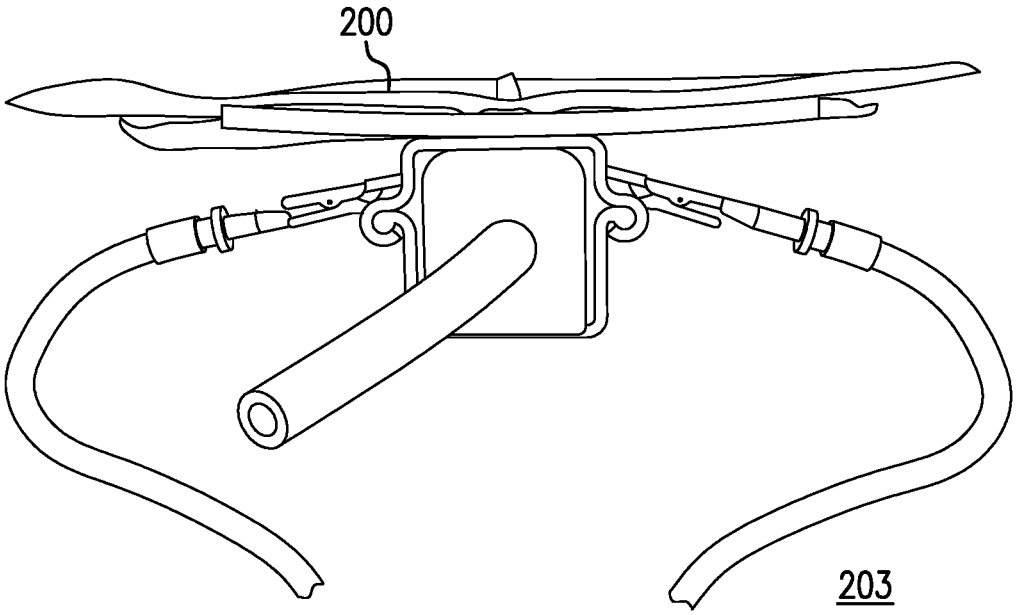
FIG. 6A is an alternate isolated view of the exemplary air cell apparatus in a retracted position according to certain embodiments.
Figure 6B:
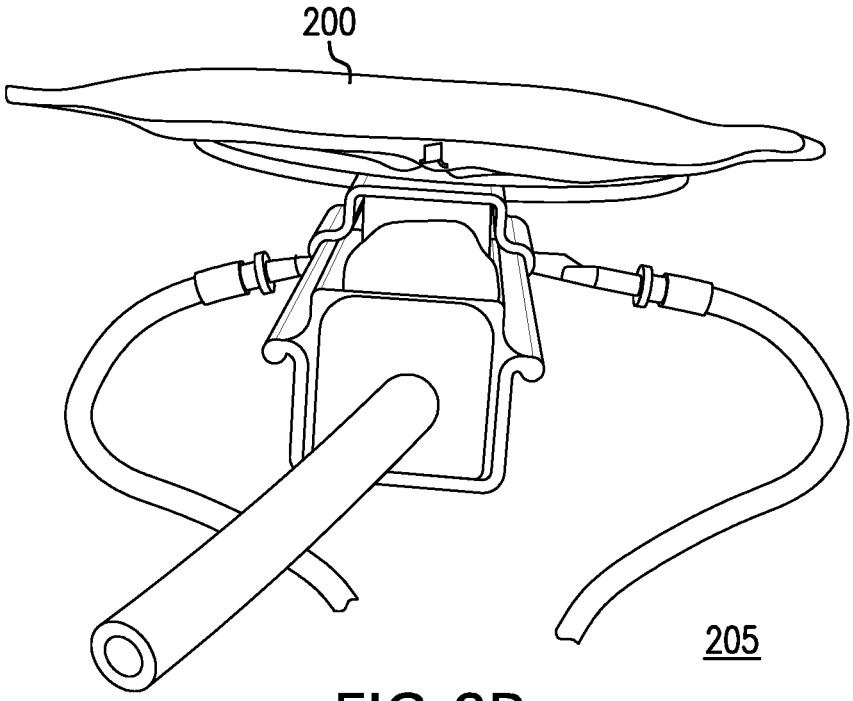
FIG. 6B is an alternate isolated view of the exemplary air cell apparatus in an extended position according to certain embodiments.

FIG. 6A is an alternate isolated view of the air cell apparatus 200 in the retracted position 203. FIG. 6B is an alternate isolated view of the air cell apparatus 200 in the extended position 205.

Figure 7:
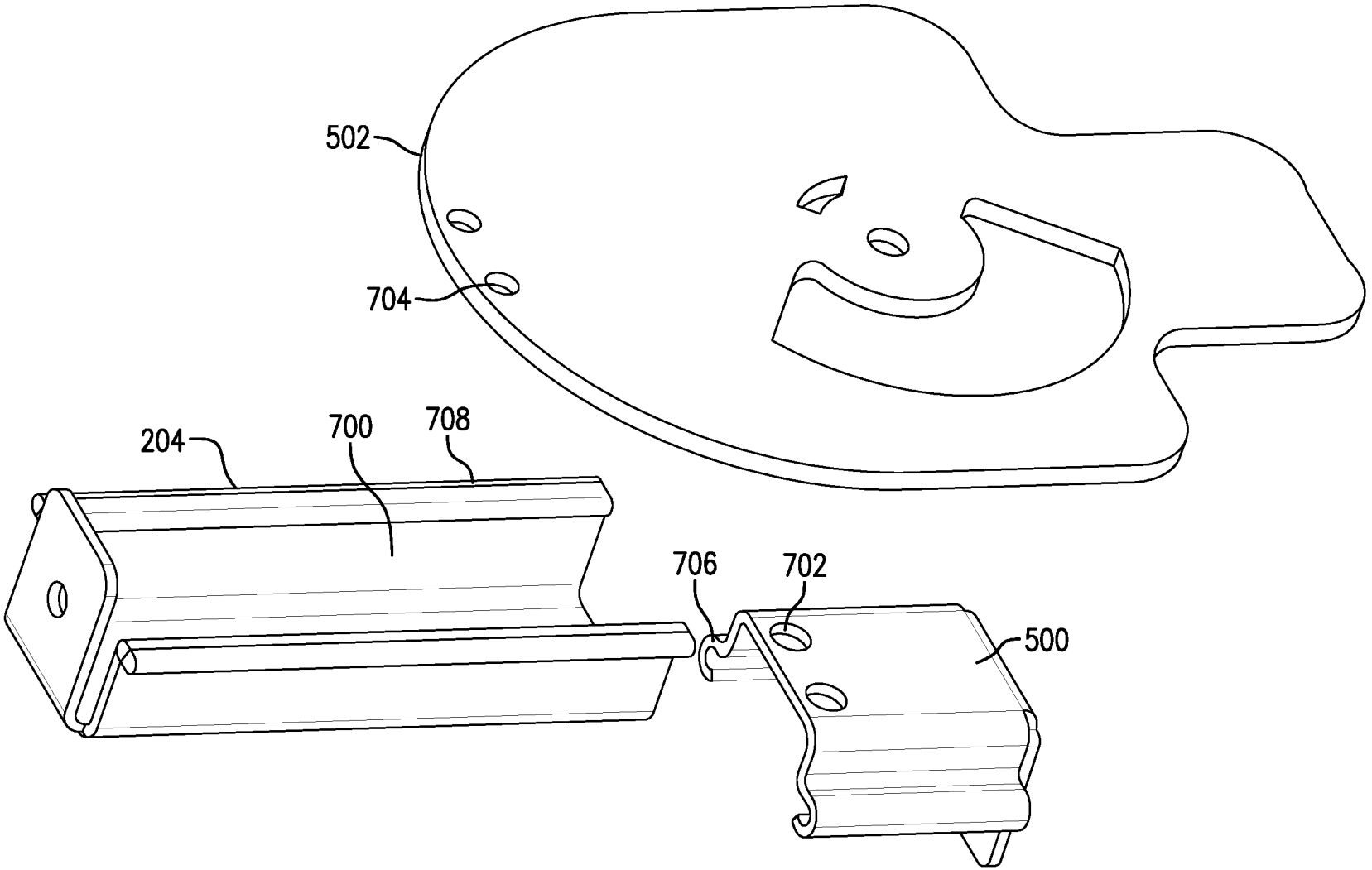
FIG. 7 is an exploded view of the exemplary air cell apparatus according to certain embodiments.

FIG. 7 is an exploded view of the mounting plate 204, the slider 500, and the air cell bladder mount 502. As mentioned above, a cavity 700 can be defined by the mounting plate 204 and the slider 500 to house the air bag 206. The slider 500 includes apertures 702 and the air cell bladder mount 502 includes apertures 704. The apertures 702, 704 can be configured to receive fasteners (e.g., screws, rivets, tabs, etc.) to couple the slider 500 to the air cell bladder mount 502. Moreover, the slider can include a female portion 706 that receives a male portion 708 of the mounting plate 204, thereby coupling the mounting plate 204 to the slider 500 and, in turn, coupling the air cell bladder mount 502 to the massage chair 100 via the mounting plate 204.

FIG. 8 discloses another exemplary embodiment of an air cell apparatus 200 that includes a first actuator driven assembly 800. The air cell apparatus 200 can operate in a similar manner as the air cell apparatus 200 described above in connection with FIGS. 2A-7, and can transition between retracted and extended positions. In this embodiment, a linear actuator 804 can be utilized to retract and extend the air cell apparatus 200. For example, the linear actuator 804 can include a motor (e.g., an electric motor) and the rotational movement of the motor can be translated into linear movements (e.g., retracting and extending movements in a linear fashion).

In further detail, the air cell apparatus 200 can include an assembly mount plate 802, a linear actuator 804, a slider 806, and one or more sliding rails 808 (e.g., a pair of sliding rails 808). The assembly mount plate 802 can be coupled to the shoulder portion 170. The sliding rails 808 can be coupled to the assembly mount plate 802, and the slider 806 can be coupled to the linear actuator 804 and the air cell bladder mount 502. The linear actuator 804 operates to move the slider 806 along the sliding rails 808 to extend the air cell bladder mount 502 outward which, as explained above, can be used to secure a body part of an individual in the massage chair 100. In some embodiments, the linear actuator 804 can be activated to extend the air cell apparatus 200 in response to a massage component 190 or massage program being initiated, or in response to receiving an input or command (e.g., via push button or input device incorporated into the massage chair 100) from an individual.

The linear actuator 804 also can operate in reverse fashion to retract the air cell apparatus 200. For example, the linear actuator 804 can cause the slider 806 to move along the sliding rails 808 to retract the air cell bladder mount 502 back towards the massage chair 100. In certain embodiments, the linear actuator 804 can be activated to retract the air cell apparatus 200 in response to a massage component 190 or massage program ending or terminating, or in response to receiving an input or command (e.g., via push button or input device incorporated into the massage chair 100) from an individual.

FIG. 9 discloses another exemplary embodiment of an air cell apparatus 200 that includes a first pneumatic assembly 900. Like many other air cell apparatuses 200 described in this disclosure, the air cell apparatus 200 can be configured to transition between retracted and extended positions. In this embodiment, the air cell apparatus 200 can utilize a pneumatically-driven connecting rods to retract and extend the air cell apparatus 200. For example, in some cases, the air cell apparatus 200 can include a bellows 904 having an accordion-shaped chamber that is configured to expand and retract. The chamber can be expanded to draw in air and retracted to expel air. The expansion and contraction of the chamber can be utilized to extend and retract connecting rods included of the air cell apparatuses 200.

In further detail, the air cell apparatus 200 can include an assembly mount plate 902, a bellows 904, connecting rods 906, a slider 908, sliding rails 910, and a spring 912. The assembly mount plate 902 can be coupled to the shoulder portion 170, the sliding rails 910 can be coupled to the assembly mount plate 902, and the slider 908 can be coupled to the connecting rods 906 and the air cell bladder mount 502. To extend the air cell apparatus 200, the bellows 904 operates to move the connecting rods 906 and, thus, the slider 908 along the sliding rails 910 to an outward or extended position. In some embodiments, bellows 904 can be configured to extend the air cell apparatus 200 in response to a massage component 190 or massage program being initiated, or in response to receiving an input or command (e.g., via push button or input device incorporated into the massage chair 100) from an individual.

The return spring 912 can be used to retract the air cell apparatus 200. For example, the return spring 912 can be configured to bias the slider 908 and move the slider 908 along the sliding rails 910 to retract the air cell bladder mount 502. In certain embodiments, the return spring 912 can retract the air cell apparatus 200 after a massage component 190 or massage program has ended or is terminated, or in response to receiving an input or command (e.g., via push button or input device incorporated into the massage chair 100) from an individual.

Figure 10:
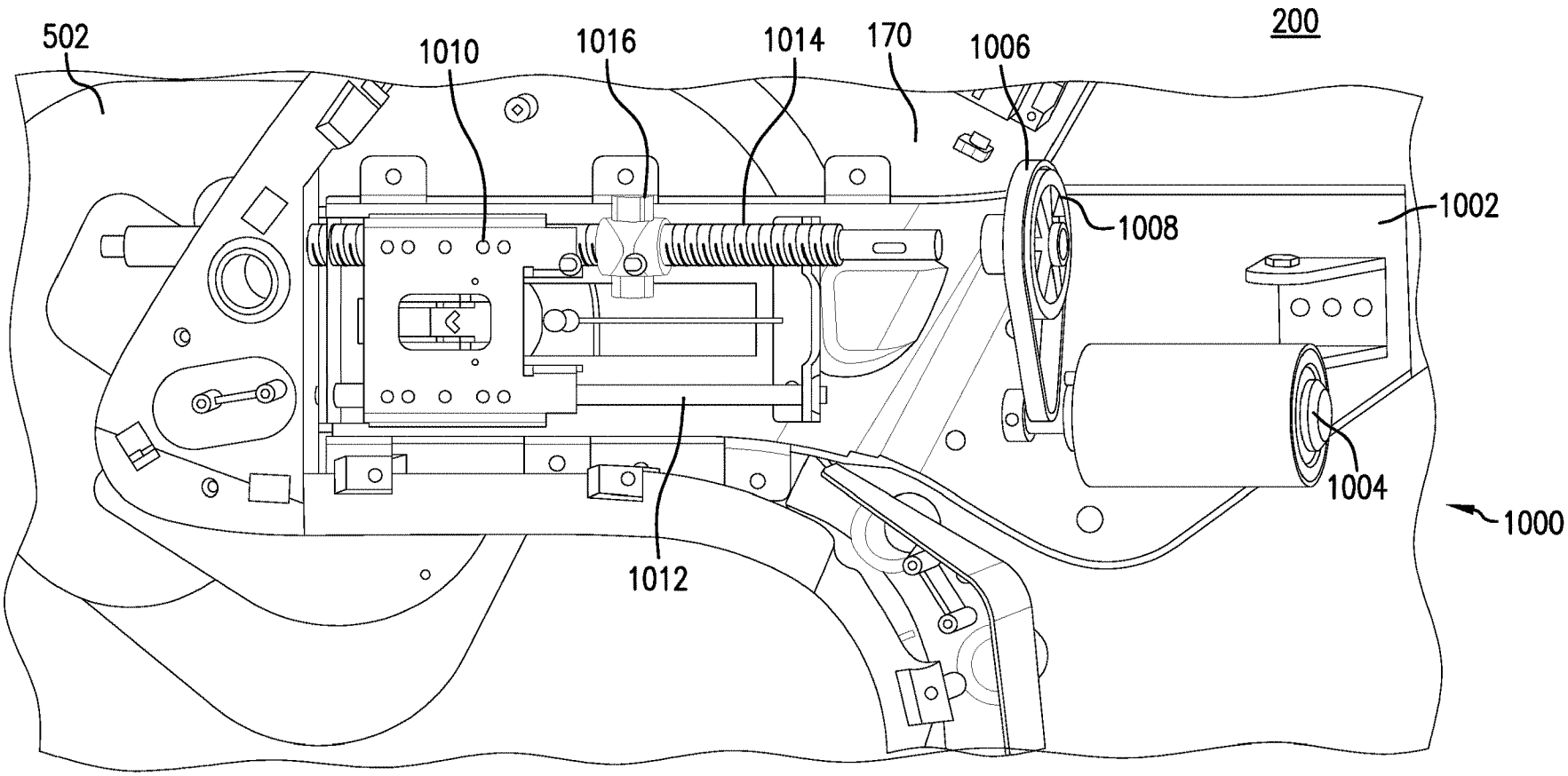
FIG. 10 is a cross-sectional view of an exemplary air cell apparatus according to certain embodiments.

FIG. 10 is another exemplary embodiment of an air cell apparatus 200. that includes a second actuator-driven assembly 1000. In particular, the air cell apparatus 200 operates in a similar manner as the air cell apparatuses 200 described above and can be configured to transition between retracted and extended positions. In this embodiment, the air cell apparatus 200 utilizes a belt-and-pulley assembly to extend and retract the air cell apparatus 200.

In further detail, the air cell apparatus 200 can include an assembly mount plate 1002, a motor 1004, a belt 1006, a gear 1008, a slider 1010, a sliding rail 1012, a screw 1014, and a nut 1016. The assembly mount plate 1002 can be coupled to the shoulder portion 170, the sliding rail 1012 can be coupled to the assembly mount plate 1002, and the slider 1010 can be coupled to the air cell bladder mount 502. The slider 1010 may be engaged with the sliding rail 1012 on one end and the screw 1014 on the other end. The slider 1010 can be coupled to the nut 1016. The screw 1014 can be coupled to the gear 1008, and the belt 1006 can be coupled to both the gear 1008 and the motor 1004.

The motor 1004 can be configured to rotate the belt 1006 and, thus, the gear 1008. Movement of the gear 1008 in a first direction threadingly engages the nut 1016 and moves the nut 1016 along a length of the screw 1014, thereby sliding the slider 1010 outward to extend the air cell bladder mount 502. Movement of the gear 1008 in a second direction threadingly engages the nut 1016 and moves the nut 1016 along a length of the screw 1014, thereby sliding the slider 1010 inward to retract the air cell bladder mount 502.

Figure 11:
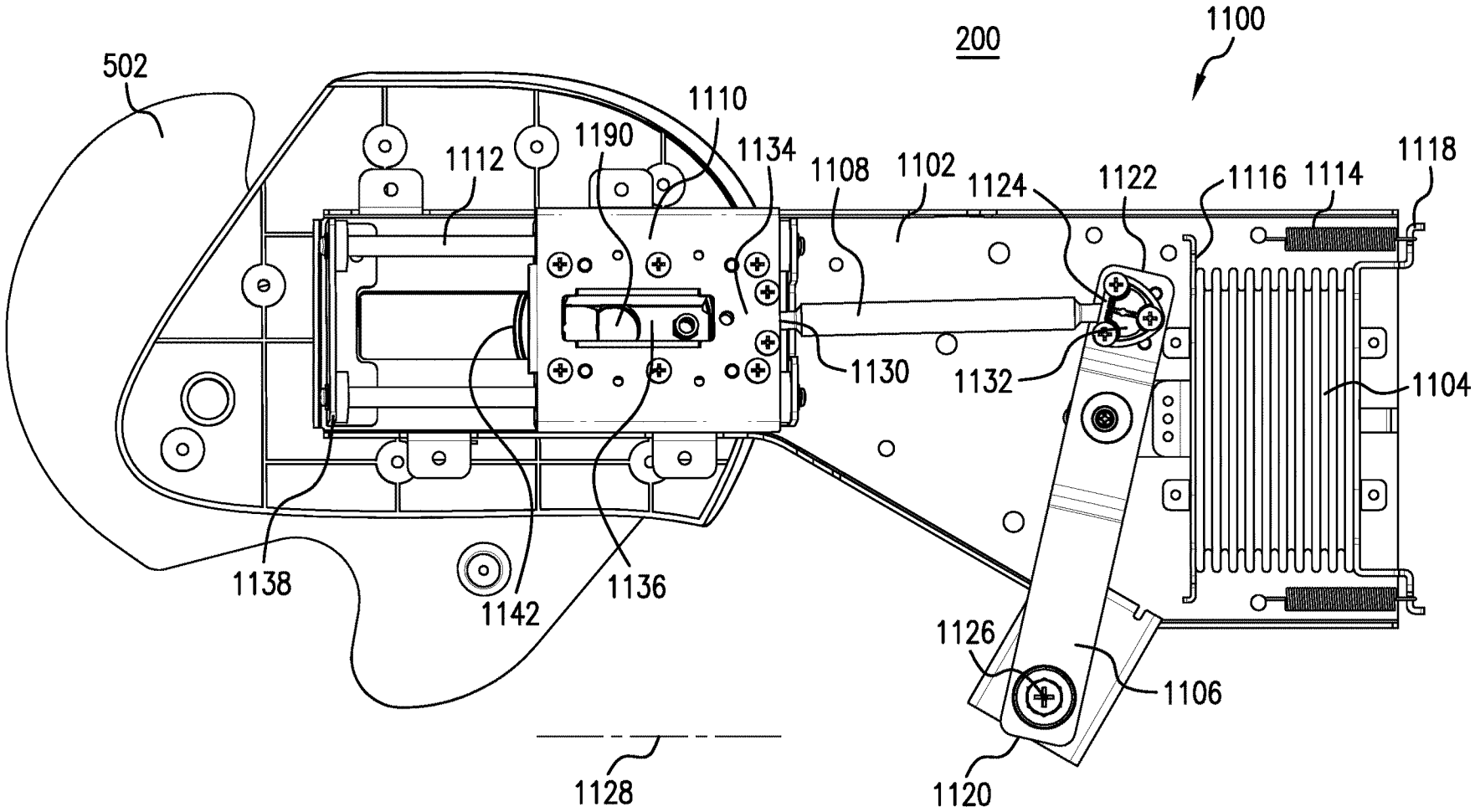
FIG. 11 is a side view of an exemplary air cell apparatus according to certain embodiments.

FIG. 11 discloses another exemplary embodiment of an air cell apparatus 200 that includes a second pneumatic assembly 1100. Like the other air cell apparatuses 200 described in this disclosure, the air cell apparatus 200 can be configured to transition between retracted and extended positions. In this embodiment, the air cell apparatus 200 can utilize pneumatically-driven connecting rods to retract and extend the air cell apparatus 200. For example, in some cases, the air cell apparatus 200 can include a bellows 1104 having an accordion-shaped chamber that is configured to expand and retract. The chamber can be expanded to draw in air and retracted to expel air. The expansion and contraction of the chamber can be utilized to extend and retract connecting rods included of the air cell apparatuses 200.

In further detail, the air cell apparatus 200 can include an assembly mount plate 1102, a bellows 1104, a first connecting rod 1106, a second connecting rod 1108, a slider 1110, sliding rails 1112, and springs 1114. The assembly mount plate 1102 can be coupled to the shoulder portion 170. In the illustrated embodiment, the bellows 1104 is coupled to the assembly mount plate 1102 via a bellows mount 1116. The bellows mount 1116 is coupled to the assembly mounting plate 1102 and the bellows mount 1116 includes protrusions 1118. The protrusions 1118 are configured to retain the springs 1114 to bias the bellows into a retracted position. In particular, the springs 1114 are coupled to the protrusions 1118 of the bellows mount 1116 to maintain a biasing force on the bellows mount 1116.

In the air cell apparatus 200 of FIG. 11 the first connecting rod 1106 includes a first end 1120 and a second end 1122. The first end 1120 of the first connecting rod 1106 is coupled to the assembly mount plate 1102 and the second end 1122 of the first connecting rod 1106 is coupled to a first end 1124 of the second connecting rod 1108. A portion of the first connecting rod 1106 is coupled to the bellows mount 1116 adjacent the second end 1122 of the first connecting rod 1106. In some embodiments, when the chamber of the bellows 1104 expands and retracts, the bellows mount 1116 operates the first connecting rod 1106 to pivot about a first pivot axis 1126, thereby extending the second end 1122 of the first connecting rod 1106 along a longitudinal axis 1128.

The second connecting rod 1108 includes the first end 1124 and a second end 1130. The first end 1124 of the second connecting rod 1108 is coupled to the second end 1122 of the first connecting rod 1106 via a first bearing cavity 1132 and the second end 1130 of the second connecting rod 1108 is coupled to the slider 1110 via a second bearing cavity 1134. In some embodiments, the first end 1124 of the second connecting rod 1108 and the second end 1130 of the second connecting rod 1108 are spherical, and thereby act as a ball bearing within the first and second bearing cavities 1132, 1134. In some embodiments, when the chamber of the bellows 1104 expands and retracts, the bellows mount 1116 operates the second connecting rod 1108 to pivot about the second end 1122 of the first connecting rod 1106 within the first bearing cavity 1132, thereby extending the second connecting rod 1108 and the slider 1110 along the longitudinal axis 1128.

As shown in FIG. 11, the slider 1110 includes the second bearing cavity 1134 and an opening 1136. The opening 1136 is configured to receive tubing (e.g., the tubing 504 of FIG. 5A) to allow air to flow to the air cell bladder (e.g., the air cell bladder 208 FIG. 5A) coupled to the air cell bladder mount 502. The slider 1110 is coupled to the sliding rails 1112 to allow the slider 1110 to move along the sliding rails 1112 along the longitudinal axis 1128. The sliding rails 1112 are coupled to the assembly mount plate 1102 via a sliding rail mount 1138.

During an operation, an individual may input or command (e.g., via push button or input device incorporated into the massage chair 100) to initiate a massage program and/or activate a massage component 190. In response activating the massage program and/or massage component 190, the bellows 1104 operates to move the first connecting rod 1106, the second connecting rod 1108, the slider 1110, and the air cell bladder mount 502 as described above. Once the air cell bladder mount 502 is in the extended position, the air cell bladder (e.g., the air cell bladder 208 of FIG. 5A) inflates to secure an individual to the massage chair 100. In response to determining that a massage program or massage component 190 has terminated, concluded, or deactivated, the air cell bladder and bellows 1104 are deflated and the springs 1114 return the bellows 1104 to the retracted position along with the first connecting rod 1106, the second connecting rod 1108, the slider 1110, and the air cell bladder mount 502 as described above.

Figure 12:
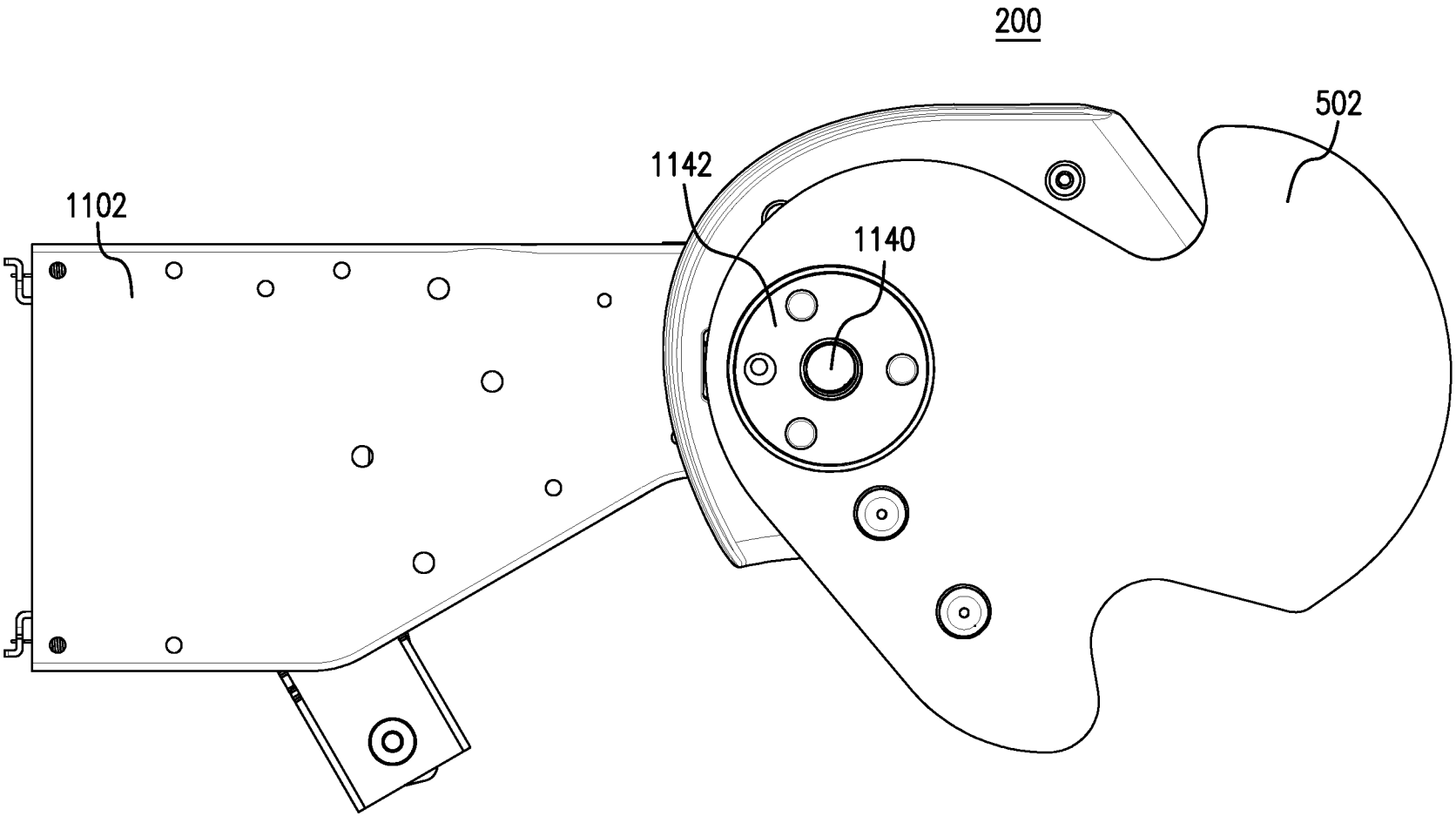
FIG. 12 is an opposite side view of the exemplary air cell apparatus of FIG. 11, according to certain embodiments.
Figure 15:
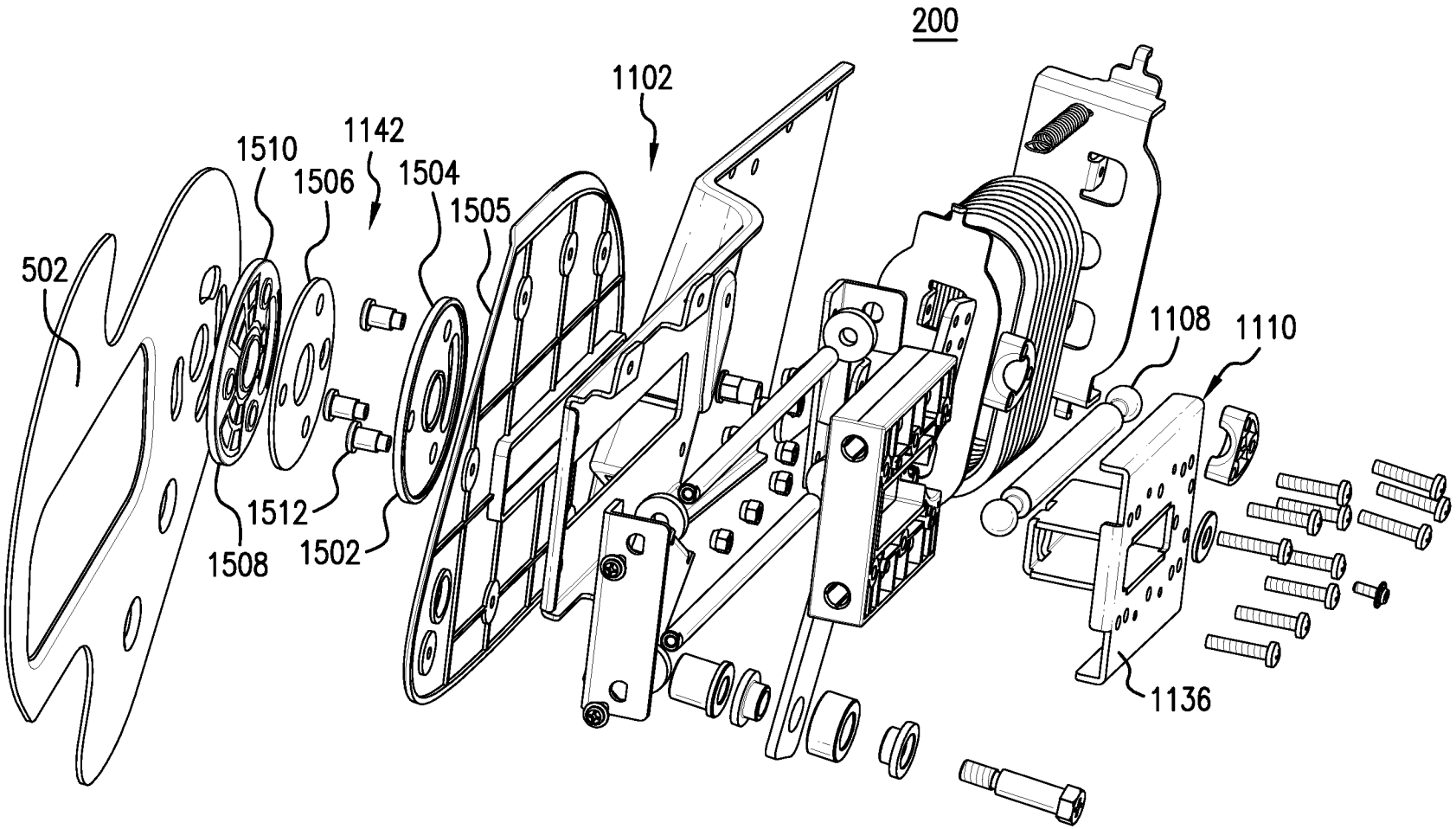
FIG. 15 is an exploded view of the exemplary air cell apparatus of FIG. 11, according to certain embodiments.
Figure 16:
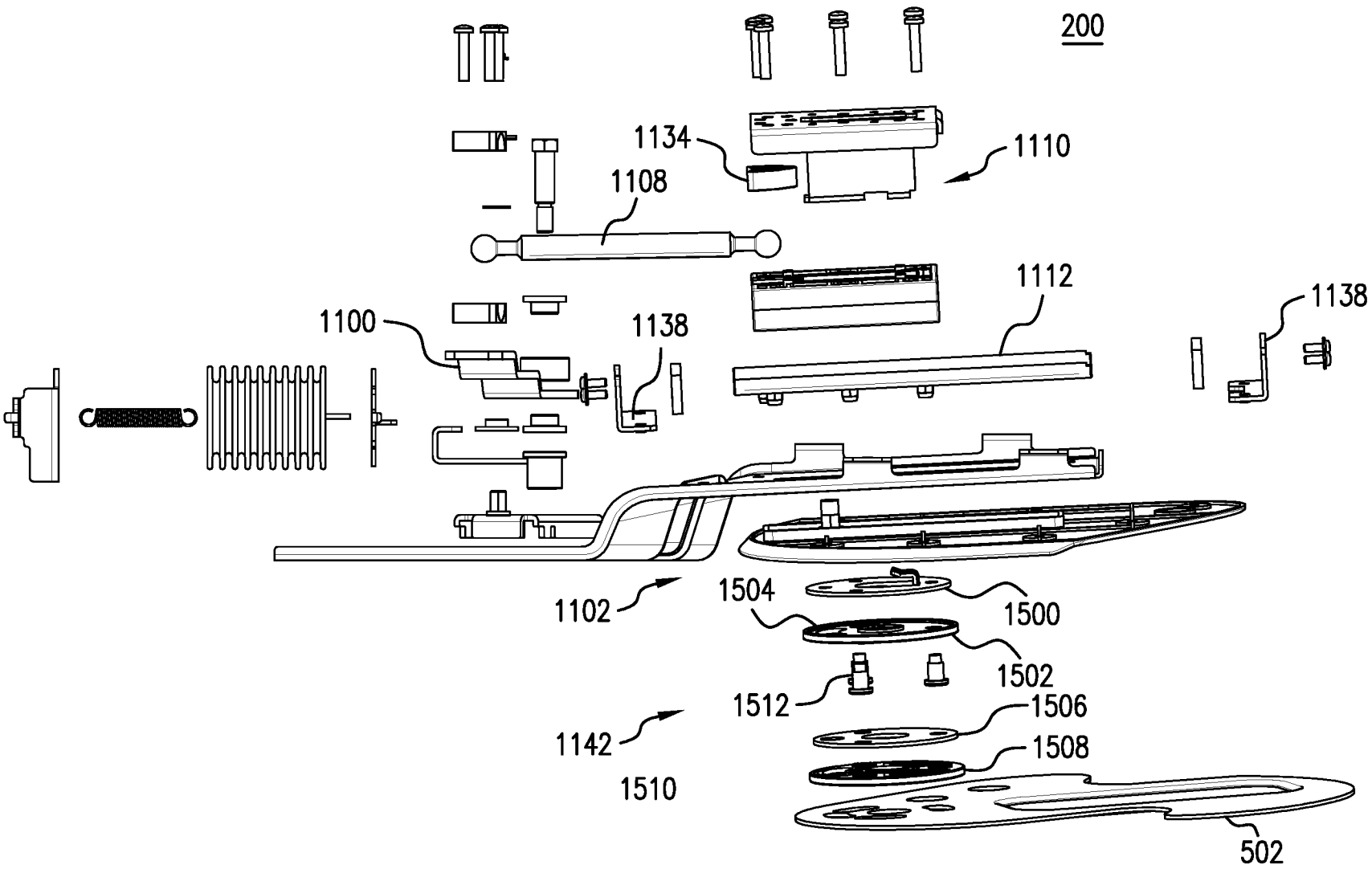
FIG. 16 is another exploded view of the exemplary air cell apparatus of FIG. 11, according to certain embodiments.

Turning to FIG. 12, the air cell bladder mount 502 can be configured to rotate about a rotation axis 1140 within a certain range. In some embodiments, the range is between 10 and 45 degrees. A rotation assembly 1142 is coupled to the assembly mount plate 1102 and the air cell bladder mount 502 to allow the air cell bladder mount 502 to rotate within the range. Turning ahead to FIGS. 15 and 16, the rotation assembly 1142 includes a first disc 1500 coupled to the assembly mount plate 1102, a second disc 1502 including a first aperture 1504, a third disc 1506, and a fourth disc 1508 coupled to the air cell bladder mount 502, which includes a second aperture 1510. In some embodiments, the first aperture 1504 and the second aperture 1510 are sized to allow the air cell bladder mount 502 to rotate between 10 and 45 degrees. For example, a fastener 1512 that passes through the third disc 1506 and couples the air cell bladder mount 502 to the rotation assembly 1142 is positioned within the first aperture 1504 and the second aperture 1510, and maneuvers within the first aperture 1504 and the second aperture 1510. This in response to a size of an individual in the massage chair 100 during administration of a massage program and/or activate of one or more massage components (e.g., a larger individual will require additional rotation of the air cell bladder mount 502 to accommodate their larger size). In particular, the air cell bladder mount 502 rotates about the rotation axis 1140 within 10-45 degrees when an individual is in the massage chair 100 to secure the individual to the massage chair 100 during a massage program.

In some embodiments, at least one air cell apparatus 200 is configured to transition from the retracted position to the extended position in response to activation of the one or more massage components or activation of a massage program. For example, air cell apparatuses 200 positioned adjacent to an individuals shoulders (or other body part) can be configured to transition from the retracted position to the extended positon. In some embodiments, the at least one air cell apparatus 200 is configured to transition from the extended position to the retracted position in response to deactivation of the one or more massage components or deactivation of a massage program.

Figure 13:
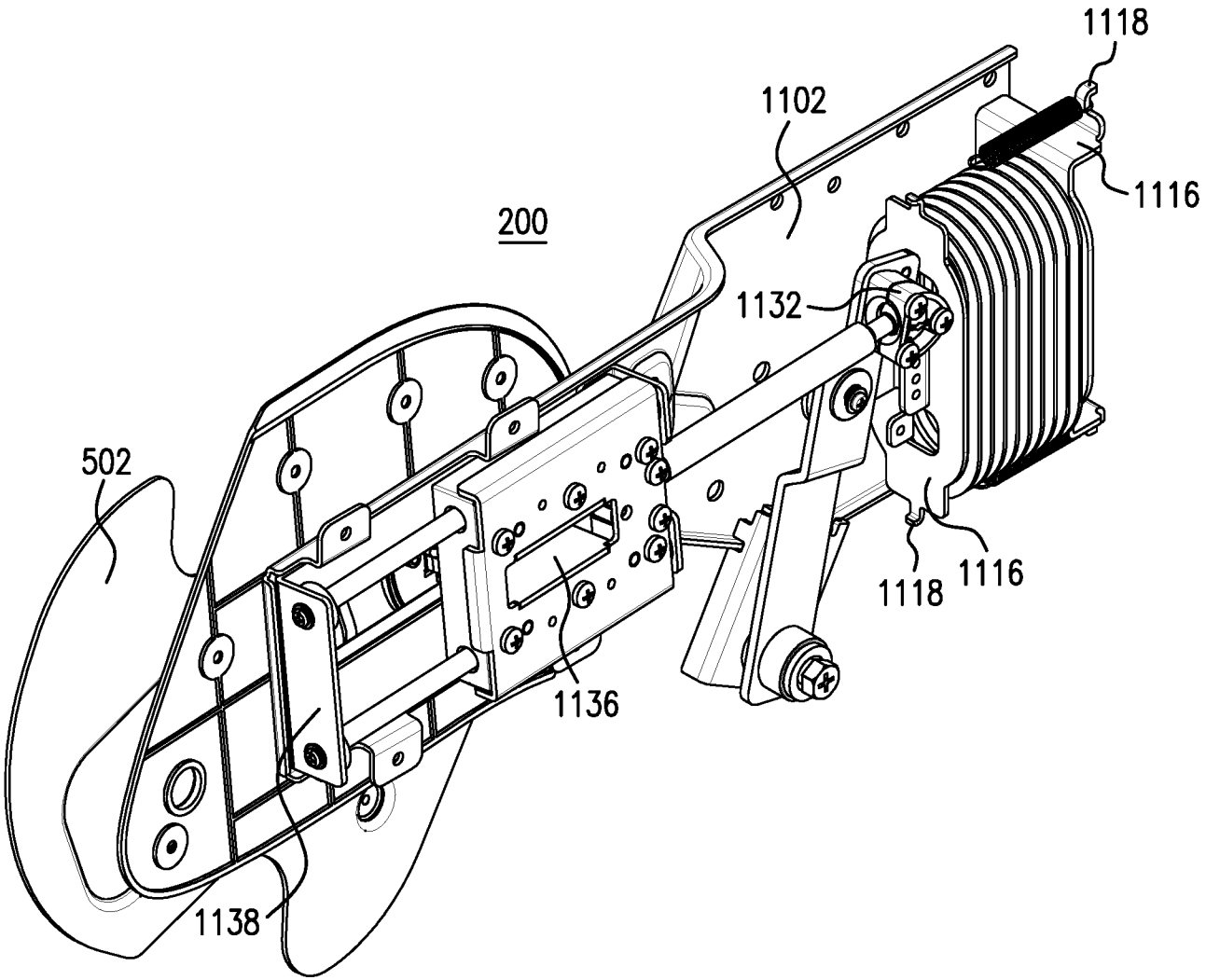
FIG. 13 is a top perspective view of the exemplary air cell apparatus of FIG. 11, according to certain embodiments.
Figure 14:
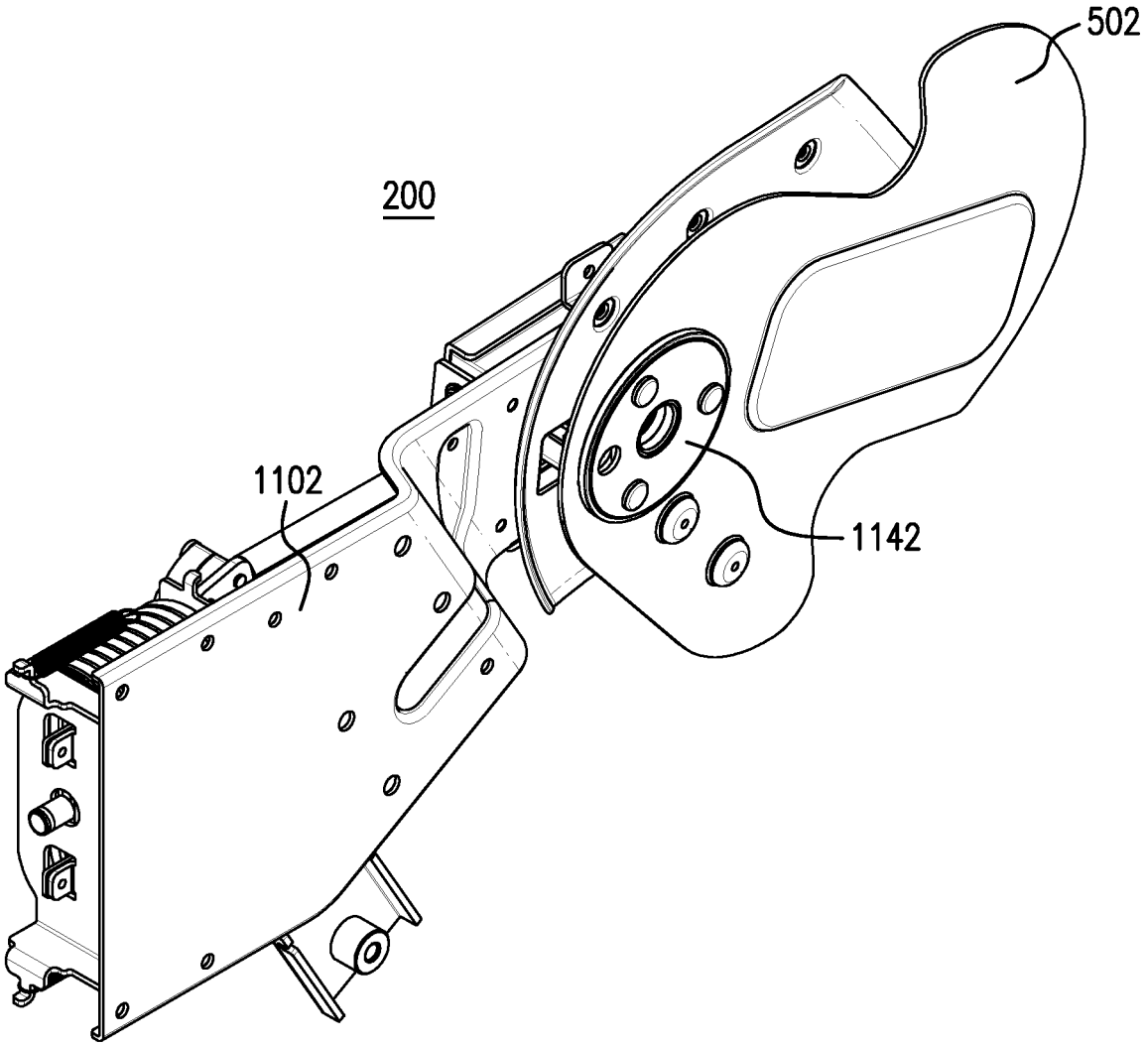
FIG. 14 is an alternate perspective view of the exemplary air cell apparatus of FIG. 11, according to certain embodiments.

FIG. 13 is a top perspective view of the exemplary air cell apparatus 200 of FIG. 11. FIG. 14 is an alternate perspective view of the exemplary air cell apparatus 200 of FIG. 11.

Figure 17:
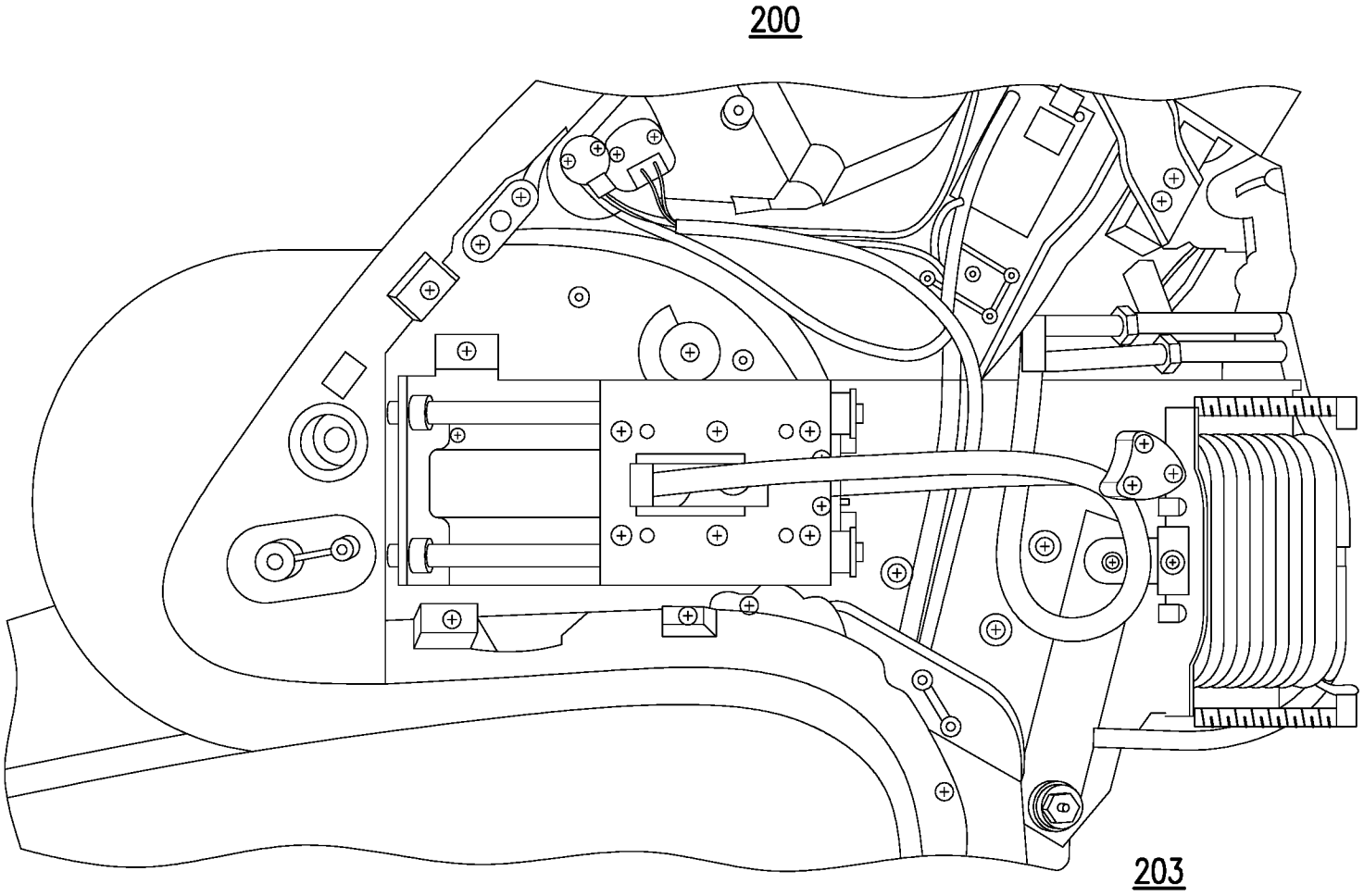
FIG. 17 is an isolated view of the exemplary air cell apparatus of FIG. 11 in a retracted position, according to certain embodiments.

FIG. 17 is an isolated view of the exemplary air cell apparatus 200 of FIG. 11 in a retracted position 203.

Figure 18:
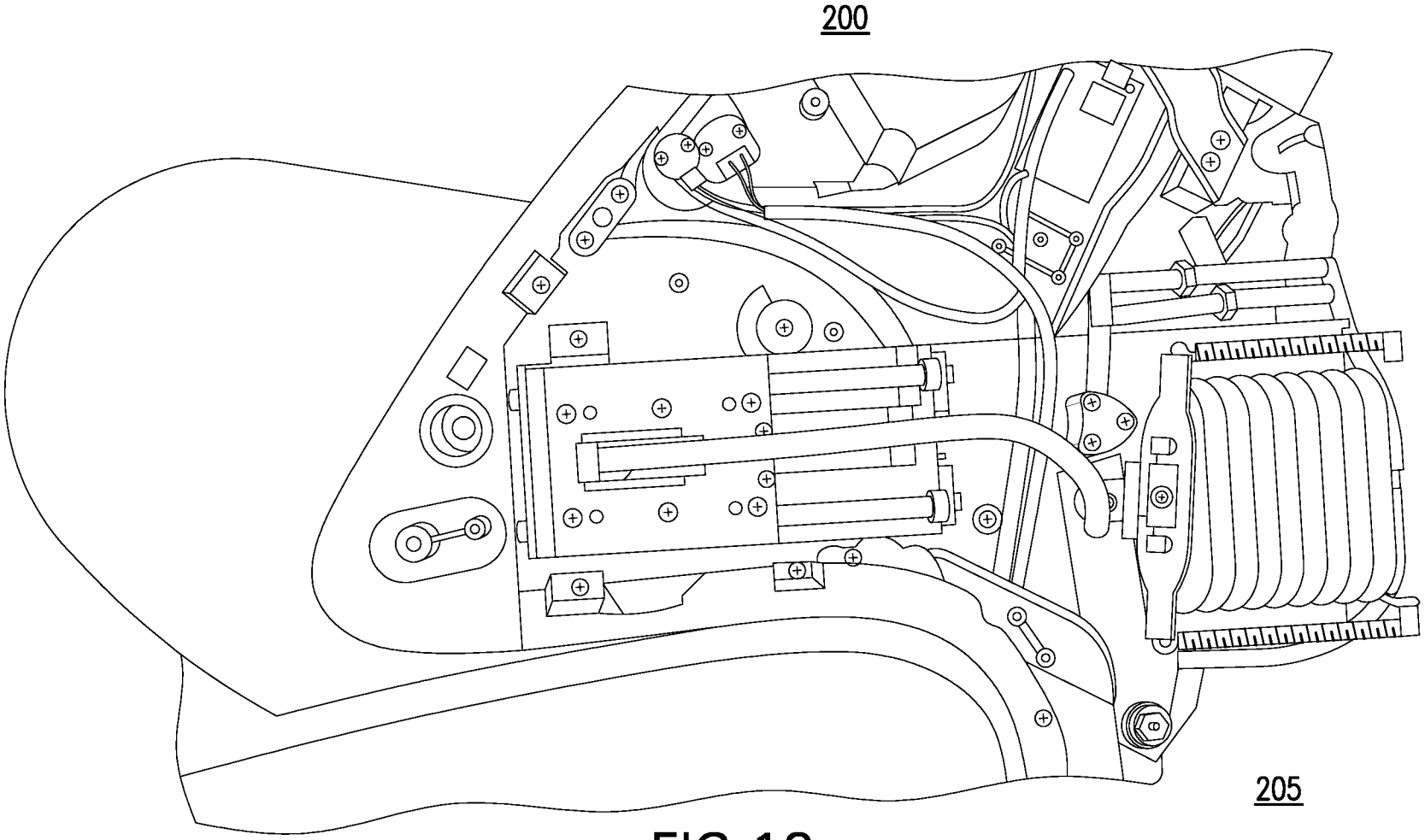
FIG. 18 is an alternate isolated view of the exemplary air cell apparatus of FIG. 11 in an extended position, according to certain embodiments.

FIG. 18 is an alternate isolated view of the exemplary air cell apparatus 200 of FIG. 11 in an extended position 205.

In certain embodiments, a massage chair is disclosed. The massage chair can include a base portion that comprises a shoulder portion and a backrest portion; one or more massage components located in or adjacent to the shoulder portion or backrest portion; at least one air cell apparatus coupled to the shoulder portion and configured to transition between a retracted position and an extended position, wherein: in the retracted position, the at least one air cell apparatus is situated adjacent to the base portion of the massage chair; in the extended position, the at least one air cell apparatus is extended outwardly from the base portion of the massage chair; and an air cell bladder positioned on the at least one air cell apparatus, wherein: the air cell bladder is configured to inflates when the at least one air cell apparatus is in the extended position; and inflation of the air cell bladder assists with securing an individual to the massage chair when the one or more massage components are activated.

In certain embodiments, a massage chair is disclosed. The massage chair can include wherein the at least one air cell apparatus is configured to transition from the retracted position to the extended position using one or more of: an air bag expansion assembly; an actuator-driven assembly; or a pneumatic assembly.

In certain embodiments, a massage chair is disclosed. The massage chair can include wherein: the at least one air cell apparatus is configured to transition from the retracted position to the extended position in response to activation of the one or more massage components or activation of a massage program; and the at least one air cell apparatus is configured to transition from the extended position to the retracted position in response to deactivation of the one or more massage components or deactivation of a massage program.

In certain embodiments, a massage chair is disclosed. The massage chair can include wherein: the at least one air cell apparatus includes an air cell bladder mount; and the air cell bladder is configured to be sealed by the air cell bladder mount to maintain air within the air cell bladder.

In certain embodiments, a massage chair is disclosed. The massage chair can include wherein; the at least one air cell apparatus further includes a bellows portion; the bellows portion is configured to retract and expand to transition the air cell apparatus between the retracted position and the extended position.

In certain embodiments, a massage chair is disclosed. The massage chair can include wherein the at least one air cell apparatus further includes: an assembly mount plate coupled to or near the shoulder portion; a connecting rod including a first end and a second end, the first end of the connecting rod being coupled to the bellows portion; a slider including a first end and a second end, the first end of the slider coupled to the second end of the connecting rod; and one or more sliding rails coupled to the assembly mount plate, wherein the slider is positioned on the one or more sliding rails.

In certain embodiments, a massage chair is disclosed. The massage chair can include wherein: the bellows portion operates to move the connecting rod which, in turn, moves the slider along the sliding rails, thereby permitting the air cell mounting plate to transition between the retracted position and the extended position.

In certain embodiments, a massage chair is disclosed. The massage chair can include wherein: the at least one air cell apparatus further includes a bellows mount and a spring including a first end and a second end; the first end of the spring is coupled to a first end of the bellows mount and the second end of the spring is coupled to a second end of the bellows mount; and the spring is configured to bias the bellows mount into the retracted position in response to completion of a massage program.

In certain embodiments, a massage chair is disclosed. The massage chair can include wherein: the massage chair includes a pair of air cell apparatuses coupled near the shoulder portion; the pair of air cell apparatuses provide assistance with securing an individual's shoulder to a backrest of the massage chair when the one or more massage components are activated.

In certain embodiments, a massage chair is disclosed. The massage chair can include a base portion; one or more massage components integrated into the massage chair; at least one air cell apparatus configured to transition between a retracted position and an extended position, wherein: in the retracted position, the at least one air cell apparatus is situated adjacent to the massage chair; in the extended position, the at least one air cell apparatus is extended outwardly from the massage chair; and an air cell bladder positioned the at least one air cell apparatus, wherein: the air cell bladder is configured to inflate when the at least one air cell apparatus is in the extended position; and inflation of the air cell bladder assists with securing an individual to the massage chair when the one or more massage components are activated.

In certain embodiments, a massage chair is disclosed. The massage chair can include wherein: the one or more massage components are located in at least one of: a shoulder portion, a backrest portion, an arm portion, or a leg rest portion; the at least one air cell apparatus is coupled on or near the shoulder portion, the backrest portion, the arm portion, or the leg rest portion; and the at least one air cell apparatus assists with securing the individual to the shoulder portion, the backrest portion, the arm portion, or the leg rest portion.

In certain embodiments, a massage chair is disclosed. The massage chair can include wherein the at least one air cell apparatus is configured to transition from the retracted position to the extended position using one or more of: an air bag expansion assembly; an actuator-driven assembly; or a pneumatic assembly.

In certain embodiments, a massage chair is disclosed. The massage chair can include wherein: the at least one air cell apparatus is configured to transition from the retracted position to the extended position in response to activation of the one or more massage components or activation of a massage program; and the at least one air cell apparatus is configured to transition from the extended position to the retracted position in response to deactivation of the one or more massage components or deactivation of a massage program.

In certain embodiments, a massage chair is disclosed. The massage chair can include wherein: the at least one air cell apparatus includes an air cell bladder mount; and the air cell bladder is configured to be sealed by the air cell bladder mount to maintain air within the air cell bladder.

In certain embodiments, a massage chair is disclosed. The massage chair can include wherein; the at least one air cell apparatus further includes a bellows portion; the bellows portion is configured to retract and expand to transition the air cell apparatus between the retracted position and the extended position.

In certain embodiments, a massage chair is disclosed. The massage chair can include wherein the at least one air cell apparatus further includes: an assembly mount plate; a connecting rod including a first end and a second end, the first end of the connecting rod being coupled to the bellows portion; a slider including a first end and a second end, the first end of the slider being coupled to the second end of the connecting rod; and one or more sliding rails coupled to the assembly mount plate, wherein the slider is positioned on the one or more sliding rails.

In certain embodiments, a massage chair is disclosed. The massage chair can include wherein: the bellows portion operates to move the connecting rod which, in turn, moves the slider along the sliding rails, thereby permitting the air cell mounting plate to transition between the retracted position and the extended position.

In certain embodiments, a massage chair is disclosed. The massage chair can include wherein: the at least one air cell apparatus further includes a bellows mount and a spring including a first end and a second end; the first end of the spring is coupled to a first end of the bellows mount and the second end of the spring is coupled to a second end of the bellows portion; and the spring is configured to bias the bellows mount into the retracted position in response to completion of a massage program.

In certain embodiments, a massage chair is disclosed. The massage chair can include wherein the massage chair includes a pair of air cell apparatuses.

In certain embodiments, an air cell apparatus for a massage chair is disclosed. The air cell apparatus can include an air cell extension assembly integrated into a massage chair, the air cell extension assembly being configured to transition between a retracted position and an extended position, wherein: in the retracted position, air cell extension assembly is situated adjacent to the massage chair; in the extended position, the air cell extension assembly is extended outwardly from the massage chair; and an air cell bladder positioned the air cell extension assembly, wherein: the air cell bladder is configured to inflate when the air cell extension assembly is in the extended position; and inflation of the air cell bladder assists with securing an individual to the massage chair when the one or more massage components are activated.

In certain embodiments, an air cell apparatus for a massage chair is disclosed. The air cell apparatus can include wherein the air cell extension assembly is configured to transition from the retracted position to the extended position using one or more of: an air bag expansion assembly; an actuator-driven assembly; or a pneumatic assembly.

As demonstrated above, various assemblies and mechanisms can be utilized to enable extension and retraction of the air cell assemblies. It should be recognized that other types of assemblies and mechanisms can be utilized to enable extension and retraction of the air cell assemblies.

Additionally, while certain portions of this disclosure may describe the air cell assemblies as being incorporated into massage chairs, it should be recognized that the air cell assemblies can be incorporated into any type of seat or chair assembly including chair assemblies that do not include massage components.

While various novel features of the invention have been shown, described and pointed out as applied to particular embodiments thereof, it should be understood that various omissions and substitutions and changes in the form and details of the systems and methods described and illustrated, may be made by those skilled in the art without departing from the spirit of the invention. Amongst other things, the steps in any methods may be carried out in different orders in many cases where such may be appropriate. Those skilled in the art will recognize, based on the above disclosure and an understanding therefrom of the teachings of the invention, that the particular hardware and devices that are part of the system described herein, and the general functionality provided by and incorporated therein, may vary in different embodiments of the invention. Accordingly, the description of system components are for illustrative purposes to facilitate a full and complete understanding and appreciation of the various aspects and functionality of particular embodiments of the invention as realized in system and method embodiments thereof. Those skilled in the art will appreciate that the invention can be practiced in ways other than the described embodiments, which are presented for purposes of illustration and not limitation. Variations, modifications, and other implementations of what is described herein may occur to those of ordinary skill in the art without departing from the spirit and scope of the present invention and its claims.

What is claimed is:

1. A massage chair comprising:

a base portion that comprises a shoulder portion and a backrest portion;

one or more massage components located in or adjacent to the shoulder portion or backrest portion;

at least one air cell apparatus coupled to the shoulder portion and configured to transition between a retracted position and an extended position, wherein:

the at least one air cell apparatus comprises: an assembly mount plate, a driving assembly, a slider, a first connecting rod, a second connecting rod, an air cell bladder mount, and an air cell bladder connected to the air cell bladder mount;

the assembly mount plate connects to a side wall of the shoulder portion directly adjacent to the backrest portion and situates the driving assembly rearwardly with respect to the backrest portion and the shoulder portion;

the first connecting rod including a first end and a second end, the first end of the first connecting rod being coupled to the assembly mount plate and the second end of the first connecting rod being coupled to the driving assembly;

the second connecting rod including a first end and a second end, the first end of the second connecting rod coupled to the slider and the second end of the second connecting rod coupled to the second end of the first connecting rod;

in the retracted position, the air cell bladder mount and air cell bladder connected thereto are situated directly adjacent to the side wall of the backrest portion;

in the extended position, the air cell bladder mount and air cell bladder connected thereto are extended outwardly away from the backrest portion of the massage chair;

the air cell bladder is configured to inflate in response to the outward extension of the air cell bladder mount and the air cell bladder connected thereto; and the driving assembly operates to move slider using the first connecting rod and the second connecting rod, thereby permitting the air cell bladder mount and air cell bladder connected thereto to transition between the retracted position and the extended position.

2. The massage chair of claim 1, wherein the driving assembly includes at least one or more of:

an air bag expansion assembly;

an actuator-driven assembly; or a pneumatic assembly.

3. The massage chair of claim 1, wherein:

the at least one air cell apparatus is configured to transition from the retracted position to the extended position in response to activation of the one or more massage components or activation of a massage program; and the at least one air cell apparatus is configured to transition from the extended position to the retracted position in response to deactivation of the one or more massage components or deactivation of a massage program.

4. The massage chair of claim 1, wherein:

the air cell bladder is configured to be sealed by the air cell bladder mount to maintain air within the air cell bladder.

5. The massage chair of claim 4, wherein:

the driving assembly further includes a bellows portion;

the bellows portion is configured to retract and expand to transition the air cell apparatus between the retracted position and the extended position.

6. The massage chair of claim 5, wherein:

the second end of the first connecting rod is coupled to the bellows portion;

and one or more sliding rails are coupled to the assembly mount plate, wherein the slider is positioned on the one or more sliding rails.

7. The massage chair of claim 6, wherein:

the bellows portion operates to move the first and second connecting rods which, in turn, moves the slider along the sliding rails, thereby permitting the air cell mounting plate to transition between the retracted position and the extended position.

8. The massage chair of claim 7, wherein:

the at least one air cell apparatus further includes a bellows mount and a spring including a first end and a second end;

the first end of the spring is coupled to a first end of the bellows mount and the second end of the spring is coupled to a second end of the bellows mount; and the spring is configured to bias the bellows mount into the retracted position in response to completion of a massage program.

9. The massage chair of claim 1, wherein:

the massage chair includes a pair of air cell apparatuses coupled near the shoulder portion;

the pair of air cell apparatuses provide assistance with securing an individual's shoulder to a backrest of the massage chair when the one or more massage components are activated.

10. A massage chair comprising:

a base portion;

one or more massage components integrated into the massage chair;

at least one air cell apparatus configured to transition between a retracted position and an extended position, wherein:

the at least one air cell apparatus comprises: an assembly mount plate, a driving assembly, a slider, a first connecting rod, a second connecting rod, an air cell bladder mount, and an air cell bladder connected to the air cell bladder mount;

the assembly mount plate connects to the massage chair and is attached to the driving assembly;

the first connecting rod including a first end and a second end, the first end of the first connecting rod being coupled to the assembly mount plate and the second end of the first connecting rod being coupled to the driving assembly;

the second connecting rod including a first end and a second end, the first end of the second connecting rod coupled to the slider and the second end of the second connecting rod coupled to the second end of the first connecting rod;

in the retracted position, the air cell bladder mount and air cell bladder connected thereto are situated directly adjacent to the massage chair;

in the extended position, the air cell bladder mount and air cell bladder connected thereto are extended outwardly away from the massage chair;

the air cell bladder is configured to inflate in response to the outward extension of the air cell bladder mount and the air cell bladder connected thereto; and the driving assembly operates to move the slider using the first connecting rod and the second connecting rod, thereby permitting the air cell bladder mount and air cell bladder connected thereto to transition between the retracted position and the extended position.

11. The massage chair of claim 10, wherein:

the one or more massage components are located in at least one of: a shoulder portion, a backrest portion, an arm portion, or a leg rest portion;

the at least one air cell apparatus is coupled on or near the shoulder portion, the backrest portion, the arm portion, or the leg rest portion; and the at least one air cell apparatus assists with securing the individual to the shoulder portion, the backrest portion, the arm portion, or the leg rest portion.

12. The massage chair of claim 10, wherein the driving assembly includes at least one or more of:

an air bag expansion assembly;

an actuator-driven assembly; or a pneumatic assembly.

13. The massage chair of claim 10, wherein:

the at least one air cell apparatus is configured to transition from the retracted position to the extended position in response to activation of the one or more massage components or activation of a massage program; and the at least one air cell apparatus is configured to transition from the extended position to the retracted position in response to deactivation of the one or more massage components or deactivation of a massage program.

14. The massage chair of claim 10, wherein:

the air cell bladder is configured to be sealed by the air cell bladder mount to maintain air within the air cell bladder.

15. The massage chair of claim 14, wherein;

the driving assembly further includes a bellows portion;

the bellows portion is configured to retract and expand to transition the air cell apparatus between the retracted position and the extended position.

16. The massage chair of claim 15, wherein:

the second end of the first connecting rod is coupled to the bellows portion;

and one or more sliding rails are coupled to the assembly mount plate, wherein the slider is positioned on the one or more sliding rails.

17. The massage chair of claim 16, wherein:

the bellows portion operates to move the first and second connecting rods which, in turn, moves the slider along the sliding rails, thereby permitting the air cell mounting plate to transition between the retracted position and the extended position.

18. The massage chair of claim 17, wherein:

the at least one air cell apparatus further includes a bellows mount and a spring including a first end and a second end;

the first end of the spring is coupled to a first end of the bellows mount and the second end of the spring is coupled to a second end of the bellows mount; and the spring is configured to bias the bellows portion into the retracted position in response to completion of a massage program.

19. An air cell apparatus for a massage chair, comprising:

an air cell extension assembly integrated into a massage chair, the air cell extension assembly being configured to transition between a retracted position and an extended position, wherein:

the at least one air cell apparatus comprises: an assembly mount plate, a driving assembly, a slider, a first connecting rod, a second connecting rod, an air cell bladder mount, and an air cell bladder connected to the air cell bladder mount;

the assembly mount plate connects to the massage chair and is attached to the driving assembly;

the first connecting rod including a first end and a second end, the first end of the first connecting rod being coupled to the assembly mount plate and the second end of the first connecting rod being coupled to the driving assembly;

the second connecting rod including a first end and a second end, the first end of the second connecting rod coupled to the slider and the second end of the second connecting rod coupled to the second end of the first connecting rod;

in the retracted position, the air cell bladder mount and air cell bladder connected thereto are situated directly adjacent to the massage chair;

in the extended position, the air cell bladder mount and air cell bladder connected thereto are extended outwardly away from the massage chair;

the air cell bladder is configured to inflate in response to the outward extension of the air cell bladder mount and air cell bladder connected thereto; and the driving assembly operates to move the slider using the first connecting rod and the second connecting rod, thereby permitting the air cell bladder mount and air cell bladder connected thereto to transition between the retracted position and the extended position.

20. The air cell apparatus of claim 19, wherein the driving assembly includes at least one or more of:

an air bag expansion assembly;

an actuator-driven assembly; or a pneumatic assembly.

21. The massage chair of claim 4, wherein the at least one air cell apparatus further includes a rotation assembly coupled to the assembly mount plate, the rotation assembly comprising:

a first disc coupled to the assembly mount plate;

a second disc abutting the first disc, the second disc including a first aperture;

a third disc abutting the second disc, the third disc including an opening;

a fourth disc coupled to the air cell bladder mount and abutting the third disc, the fourth disc includes a second aperture; and a fastener, the fastener positioned within the first aperture, the opening, and the second aperture to couple the rotation assembly to the air cell bladder mount, wherein the fastener allows the rotation assembly to rotate between 10 and 45 degrees relative to the assembly mount plate.

* * * * *